US011186934B2

(12) United States Patent
Im et al.

(10) Patent No.: US 11,186,934 B2
(45) Date of Patent: Nov. 30, 2021

(54) METHOD FOR CONTROLLING WASHING MACHINE

(71) Applicant: LG Electronics Inc., Seoul (KR)

(72) Inventors: Myunghun Im, Seoul (KR); Hwanjin Jung, Seoul (KR); Jaehyun Kim, Seoul (KR); Junghoon Lee, Seoul (KR); Kyungchul Woo, Seoul (KR)

(73) Assignee: LG Electronics Inc., Seoul (KR)

( * ) Notice: Subject to any disclaimer, the term of this patent is extended or adjusted under 35 U.S.C. 154(b) by 94 days.

(21) Appl. No.: 16/235,767

(22) Filed: Dec. 28, 2018

(65) Prior Publication Data

US 2019/0203402 A1 Jul. 4, 2019

(30) Foreign Application Priority Data

Dec. 28, 2017 (KR) ..... 10-2017-0182263
Jan. 5, 2018 (KR) ..... 10-2018-0001837

(51) Int. Cl.
*D06F 37/30* (2020.01)
*D06F 35/00* (2006.01)
(Continued)

(52) U.S. Cl.
CPC ..... *D06F 33/36* (2020.02); *D06F 39/088* (2013.01); *D06F 2103/02* (2020.02);
(Continued)

(58) Field of Classification Search
CPC .... D06F 33/00–76; D06F 34/00; D06F 34/16; D06F 35/005–007; D06F 39/083;
(Continued)

(56) References Cited

U.S. PATENT DOCUMENTS

2009/0249840 A1* 10/2009 Jo ..... D06F 39/083 68/5 C
2012/0103026 A1* 5/2012 Oyama ..... D06F 34/22 68/13 R
(Continued)

FOREIGN PATENT DOCUMENTS

EP 2169105 3/2010
EP 2113600 B1 * 1/2011 ..... D06F 37/203
(Continued)

OTHER PUBLICATIONS

PCT International Search Report in International Application No. PCT/KR2018/016850, dated Apr. 26, 2019, 3 pages.
(Continued)

*Primary Examiner* — Michael E Barr
*Assistant Examiner* — Omair Chaudhri
(74) *Attorney, Agent, or Firm* — Fish & Richardson P.C.

(57) ABSTRACT

A method of controlling a washing machine that includes a tub, a drum rotatably disposed in the tub, at least one nozzle spraying water toward the drum, a washing motor rotating the drum, and a circulation pump circulating water discharged from the tub, the method including: supplying a first level of water into the tub; operating the circulation pump at a first speed; controlling a rotation of the drum to repeatedly alternate between an acceleration and a deceleration so that laundry in the drum alternates between maintaining contact with an inner surface of the drum and separating from the inner surface of the drum; further supplying water to the tub to raise the first water level to a second water level.

12 Claims, 20 Drawing Sheets

(51) Int. Cl.

| | |
|---|---|
| ***D06F 33/00*** | (2020.01) |
| ***D06F 39/08*** | (2006.01) |
| ***D06F 33/36*** | (2020.01) |
| *D06F 103/02* | (2020.01) |
| *D06F 103/24* | (2020.01) |
| *D06F 105/06* | (2020.01) |
| *D06F 105/46* | (2020.01) |
| *D06F 105/48* | (2020.01) |

(52) U.S. Cl.
CPC ..... *D06F 2103/24* (2020.02); *D06F 2105/06* (2020.02); *D06F 2105/46* (2020.02); *D06F 2105/48* (2020.02)

(58) Field of Classification Search
CPC ..... D06F 39/085; D06F 39/088; D06F 39/08–088
See application file for complete search history.

(56) References Cited

U.S. PATENT DOCUMENTS

2012/0180534 A1* 7/2012 Cho ..... D06F 35/006 68/18 R
2015/0299926 A1* 10/2015 Kim ..... D06F 35/006 8/137
2016/0115635 A1* 4/2016 Lee ..... D06F 39/083 68/17 R
2019/0323162 A1* 10/2019 Jung ..... D06F 37/266

FOREIGN PATENT DOCUMENTS

| | | | | |
|---|---|---|---|---|
| EP | 2169105 | B1 * | 12/2013 | ..... D06F 33/00 |
| EP | 2937454 | | 10/2015 | |
| EP | 2987902 | | 2/2016 | |
| JP | 2014083167 | | 5/2014 | |
| JP | 2014083167 | A * | 5/2014 | |
| JP | 2014212809 | | 11/2014 | |
| JP | 2014212809 | A * | 11/2014 | |
| KR | 1020110029459 | | 3/2011 | |
| KR | 1020160044901 | | 4/2016 | |
| WO | WO2011025311 | | 3/2011 | |

OTHER PUBLICATIONS

Extended European Search Report in European Application No. 18215074.8, dated May 22, 2019, 5 pages.

* cited by examiner

METHOD FOR CONTROLLING WASHING MACHINE

CROSS-REFERENCE TO RELATED APPLICATIONS

This application claims the benefit of an earlier filing date and right of priority to Korean Patent Application Nos. 10-2017-0182263 filed on Dec. 28, 2017 and 10-2018-0001837 filed on Jan. 5, 2018 in the Korean Intellectual Property Office, the disclosures of which are herein incorporated by reference in their entirety.

TECHNICAL FIELD

The present invention relates to a method for controlling a washing machine having a circulation pump that circulates wash water.

BACKGROUND

Generally, a washing machine is a generic name for an apparatus that removes contaminants from clothing, bed sheets, etc. (hereinafter, referred to as "laundry") using chemical decomposition of detergent with water and a physical force such as friction between water and the laundry. The washing machine has a rotary cylindrical drum installed in a tub for containing water, the drum in which a plurality of through holes is formed. If the washing machine is operated with laundry loaded in the drum, water is supplied with detergent into the tub and/or the drum and the drum starts to rotate, performing a washing operation.

In order to improve washing performance and prevent laundry to be stained by detergent, the detergent supplied the water needs to be dissolved uniformly. Conventionally, water is supplied with water in an initial washing operation, the drum rotates with being filled with water to a certain level, and the water is stirred upon rotation of the drum to dissolve the detergent.

However, this method is applicable only when the level of water in the tub is high enough to fill water to the certain level in the drum, and thus, if a predetermined amount of detergent is supplied, a concentration level of wash water does not exceed a predetermined level. Furthermore, some of the water supplied with the detergent (hereinafter, referred to as "wash water") is absorbed into laundry and thus the level of water in the tub decreases. In order to compensate for the decreased water level, it is required to additionally supply more water, which results in further decrease in the concentration level of the wash water. As a result, it is not possible to wash the laundry with highly detergent concentrated wash water.

In addition, in this method, an area away from the drum is less influenced by the rotation of the drum, and thus, in such an area, a water flow is not strong and detergent cannot be dissolved well. For example, detergent is not dissolved well within a drain bellows configured to guide water discharged from a tub to a circulation pump or within a circulation pump housing.

Japanese Patent Application Publication No. 2010036016A (hereinafter, referred to as "Related Art 1") discloses a washing machine in which wash water is circulated using a BLDC motor-adopted circulation pump to be sprayed into a drum (a water container). Related Art rotates the circulation pump at 2500 rpm in a normal operation to provide circulating water to a region deep inside the drum at a high angle, and, when an amount of laundry sensed by a load amount sensing means is determined to be smaller than a predetermined value, Related Art rotates the circulation pump 2500 rpm to soak laundry positioned at the bottom of the drum at a low angle. Related Art 1 adjusts a speed of the circulation pump but still sprays circulating water into the drum, and thus, it still difficult to form highly detergent concentrated wash water before applying water to laundry.

Japanese Patent Application Publication No. 2008/113982A (hereinafter, referred to as "Related Art 2") discloses a washing machine having a circulation pump capable of rotating forward/backward. The circulation pump includes one impeller provided in a casing having two outlet ports. One of the two outlet ports (hereinafter, referred to as a "first outlet port) is for dissolving detergent, and the other one of the two outlet ports (hereinafter, referred to as a "second outlet port) is for supplying circulating water to a circulation nozzle. In the casing, there are a first partition plate configured to prevent water from being discharged through the second outlet port when the impeller rotates backward, and a second partition plate configured to prevent water from being discharged through the first outlet port when the impeller rotates forward.

The water (detergent dissolved water) discharged through the first outlet port by the backward rotation of the impeller flows along a predetermined pipe and is recovered back to the tub through an inlet hole formed at the bottom of the tub (water tank). That is, when the impeller rotates backward, water circulates in a manner in which the water discharged from the tub is pumped by the circulation pump and flows back into the tub. In particular, in this process, the circulating water does not flow into the drum, but reaches only a concave space provided at a lower side of the tub, which is not in touch with the drum, and therefore, it is possible to prevent incompletely dissolved detergent from being applied to laundry in the drum and to form highly detergent concentrated wash water before applying water to the laundry.

However, Related Art 1 needs to have an additional circulation flow path for dissolving detergent, as well as a flow path for spraying wash water into the drum.

In addition, in Related Art 2, as a backward rotation speed of the impeller increases, a flow rate at the first outlet port increases, thereby reducing a circulation period of wash water. Thus, the wash water is not agitated by the impeller in one circulation period.

SUMMARY

The first object of the present invention is to provide a method for controlling a washing machine, the method which enables detergent to be uniformly dissolved in wash water using a circulation pump.

The second object of the present invention is to provide a method for controlling a washing machine, the method which enables laundry to be uniformly soaked in detergent-dissolved wash water.

The third object of the present invention is to provide a method for controlling a washing machine, the method which prevents laundry from being contaminated by incompletely dissolved detergent.

The fourth object of the present invention is to provide a washing machine and a method for controlling the same, which perform a detergent dissolving step using a nozzle for spraying circulating water pumped by the circulation pump, wherein the circulating water is prevented from reaching the inside of the drum during the detergent dissolving step so as to prevent incompletely dissolved detergent from being applied to laundry.

These objects are achieved with the features of the claims.

In one general aspect of the present invention, there is provided a method for controlling a washing machine having a tub for containing water, a drum rotatably provided in the tub, at least one nozzle disposed in front of the drum to spray water toward the drum, a washing motor configured to rotate the drum, and a circulation pump configured to circulate water discharged from the tub to the at least one nozzle.

The method includes: a step of supplying water with detergent into the tub to a first water level; and a step of operating the circulation pump at a first speed. The first speed is set within a range in which the water discharged from the circulation pump is not allowed to reach any of the at least one nozzle or, even if the water reaches the at least one nozzle, the jetted water is not allowed to reach an inner side of the drum.

The washing pump is repeatedly accelerated braked while the circulation pump operates at the first speed. Laundry in the drum becomes stuck to an inner circumferential surface of the drum in response to the acceleration of the washing motor, and the laundry falls from the inner circumferential surface of the drum in response to the deceleration of the washing motor.

The braking of the washing motor may be performed when laundry is lifted from a lowest point in the drum to a height corresponding to a set angle that is set less than a rotation angle of 180 degrees of the drum.

The first speed may be equal to or lower than 1500 rpm.

Then, a step of repeating operation and stopping of the circulation pump multiple times while continuously rotating the washing motor in one direction (hereinafter, referred to as a "washing step") may be performed. While the washing motor continuously rotates in the washing step, the laundry in the drum may be lifted to a predetermined height and falls therefrom, repeatedly, while the washing motor continuously rotates in one direction. In this case, the washing motor may be decelerated after the drum 360 rotates 360 degrees or more.

A step of additionally supplying water into the tub may be further performed in the washing step. In the washing step, a rotation speed of the circulation pump may be set to be higher than a rotation speed in a previous operation when the operation of the circulation pump is performed multiple times and the operation of the circulation pump is performed after the water is additionally supplied into the tub.

In the step (e), the operation of the circulation pump may be repeated multiple times in response to the continuous rotation of the washing motor multiple times in one direction, and the multiple-times operation of the circulation pump may include: a first operation in which the circulation pump rotates at a first rotation speed; and a second operation in which the circulation pump rotates at a second rotation speed higher than the first rotation speed after the first operation.

The at least one nozzle may include: two or more lower nozzles which spray water toward a first area on the inner circumferential surface of the drum; two or more middle nozzles which are supplied with water along a flow path shared with the two or more lower nozzles, and which are disposed higher than the two or more lower nozzles in the flow path and thus spray water toward a second area on the inner circumferential surface of the drum. The rotation of the circulation pump in the washing step may be controlled such that water is sprayed from the two or more lower nozzles and the two or more middle nozzles.

In the washing step, a step of controlling the circulation pump such that water pumped by the circulation pump is sprayed through the two or more lower nozzles but fails to reach the two or more nozzles may be performed.

The washing machine may further include a direct water nozzle for spraying water, supplied through a water supply valve, into the drum. The washing step may include a step of opening the water supply valve to spray the water through the direct water nozzle while the water is sprayed through the two or more middle nozzles and the two or more lower nozzles.

A step of accelerating the washing motor to a contact maintaining speed such that the laundry in the drum rotates while stuck to an inner circumferential surface of the drum, and rotating the washing motor with maintaining the contact mainlining speed, and a step of accelerating the circulation pump in response to the acceleration of the washing motor such that the water is sprayed through the at least one nozzle may be further performed after the washing step.

The method for controlling a washing machine according to the present invention causes wash water to be stirred by the circulation pump at a low water level, thereby uniformly dissolving detergent in wash water. Then, since the wash water is supplied to laundry through at least one nozzle with a water level risen by additional water supply, the detergent may be uniformly applied to the laundry and incompletely dissolved detergent residues may not remain in the laundry after completion of washing.

The method of controlling a washing machine according to the present invention utilizes highly detergent concentrated wash water in the initial washing stage, thereby improving washing performance. That is, as the level of water in the tub is increased in phases, contaminants may be removed from laundry with the highly detergent concentrated wash water in the initial washing stage and then laundry may be washed with a risen level of water in the tub using a water stream sprayed from a nozzle, thereby improving washing performance.

In addition, as the circulation pump motor may be controlled to change the number of water streams sprayed from a plurality of nozzles in a washing process, washing may be performed by adjusting an amount of circulating water according to the water level.

In addition, as the detergent dissolving step is performed using a nozzle formed in the gasket, a simple structure may be achieved without an additional circulation flow path for the detergent dissolving step, and the detergent dissolving step may be easily performed using an existing washing machine.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION

Figure 1:
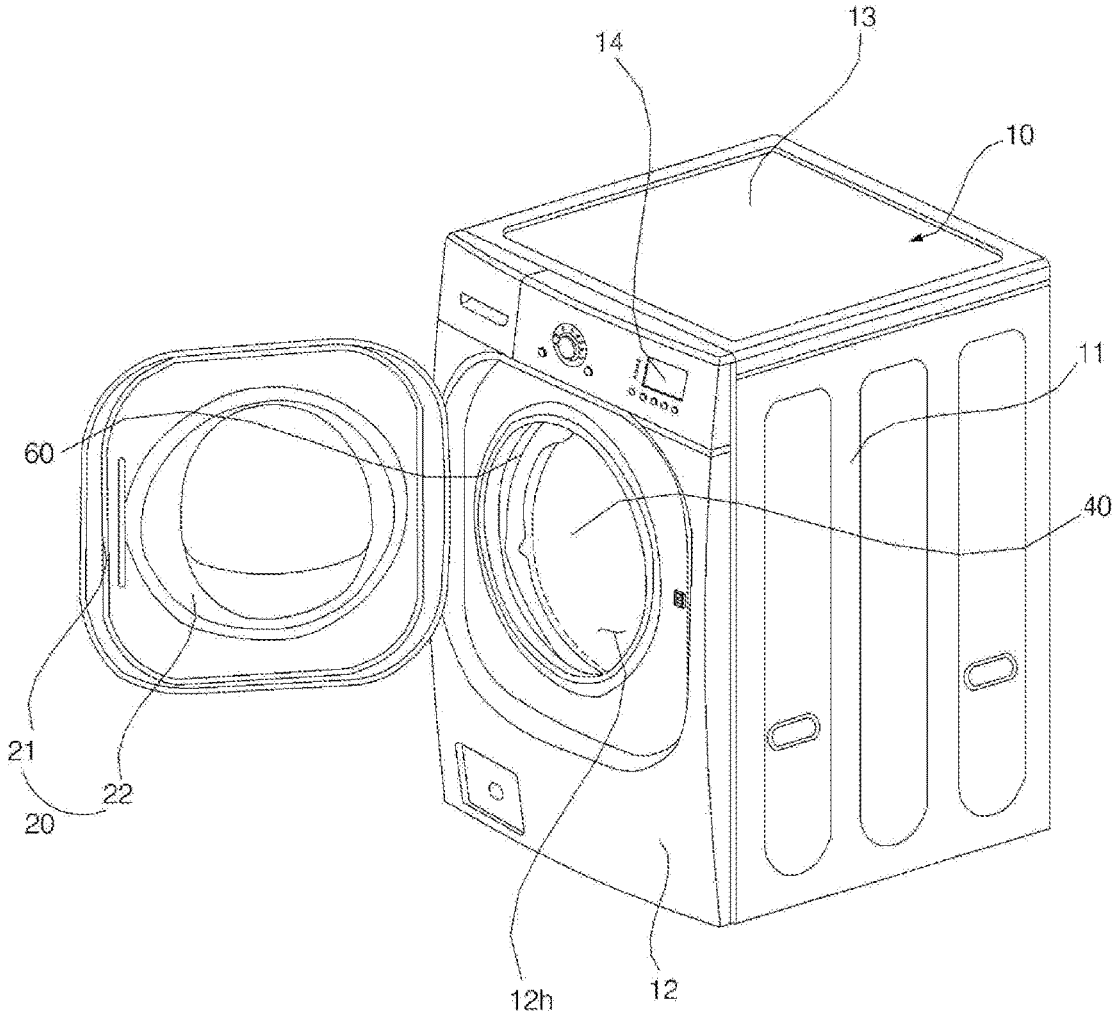
FIG. 1 is a perspective view illustrating a washing machine according to an embodiment of the present invention.
Figure 2:
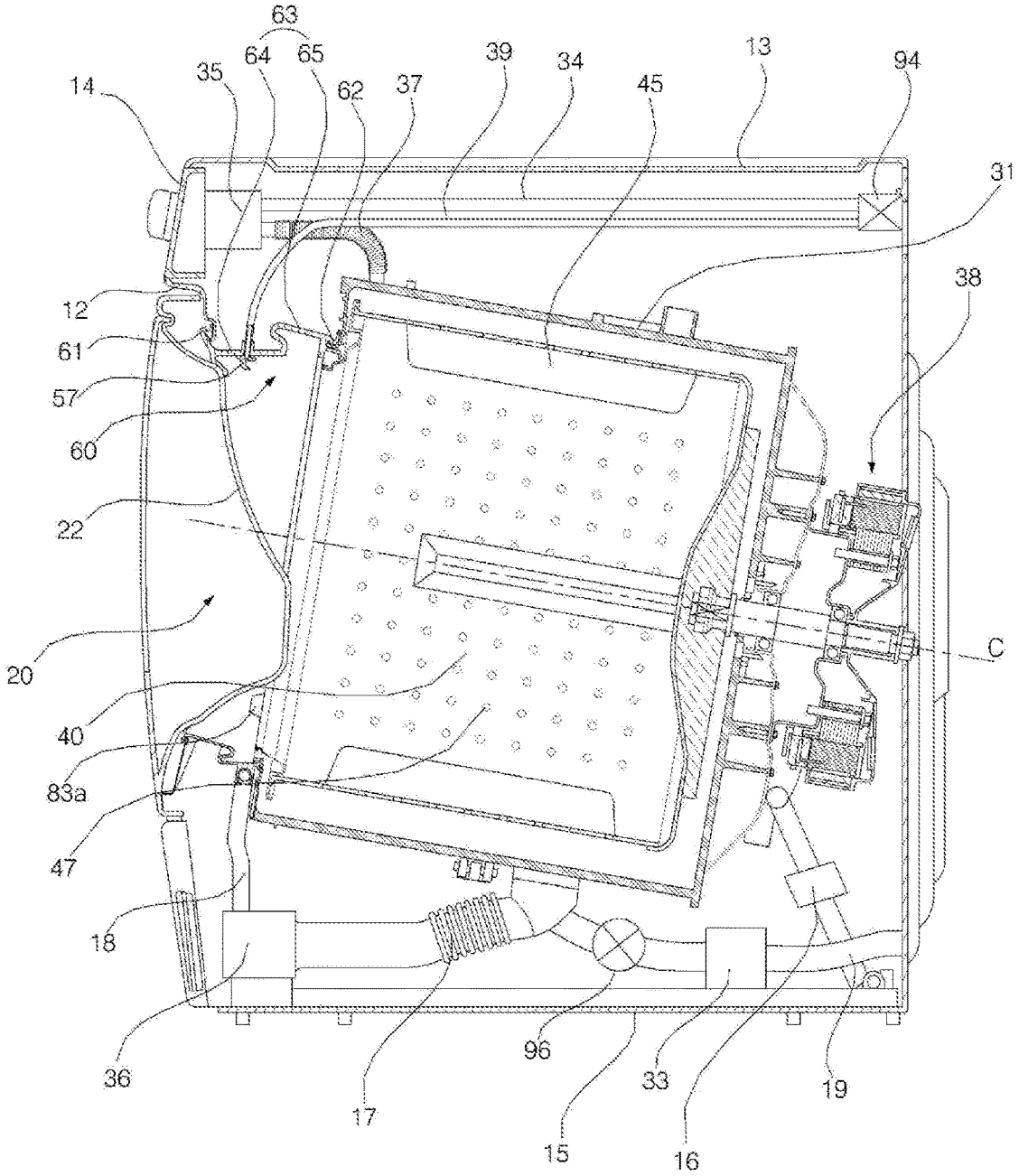
FIG. 2 is a cross-sectional view illustrating the washing machine illustrated in FIG. 1.
Figure 3:
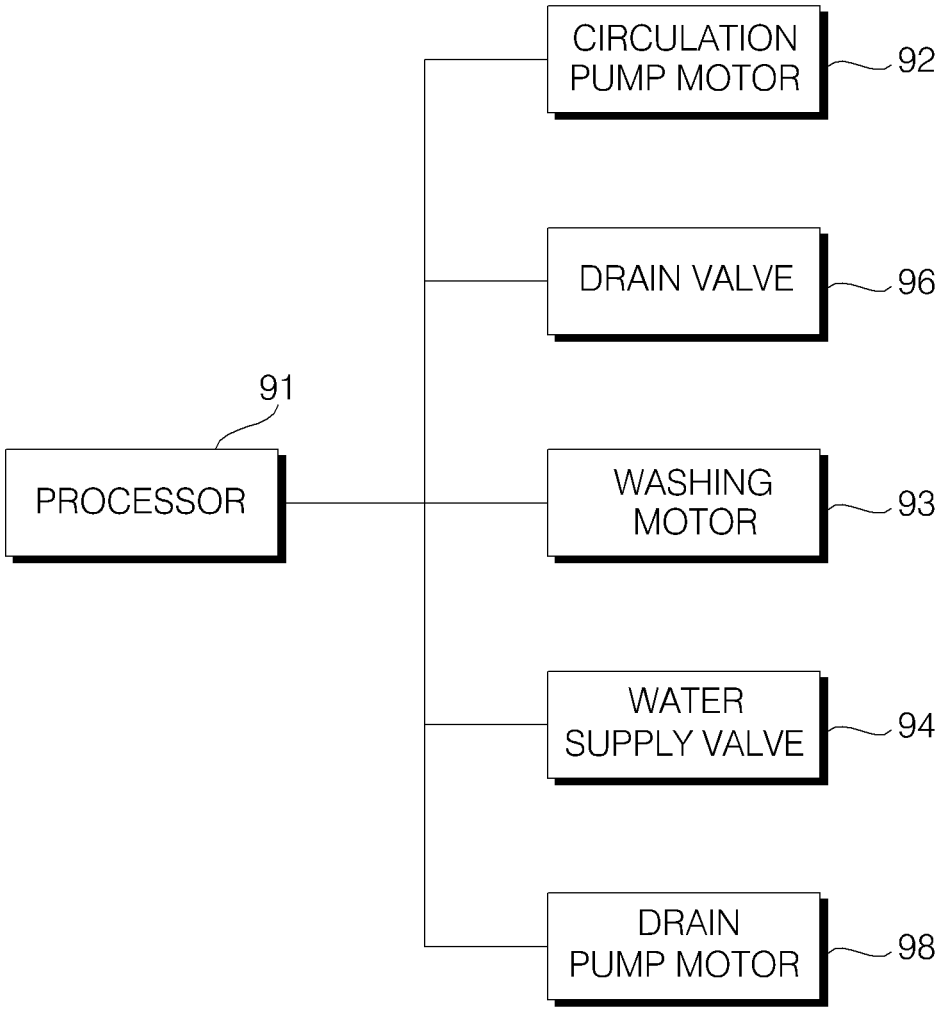
FIG. 3 is a block diagram illustrating a control relationship between major components of a washing machine according to an embodiment of the present invention.
Figure 4:
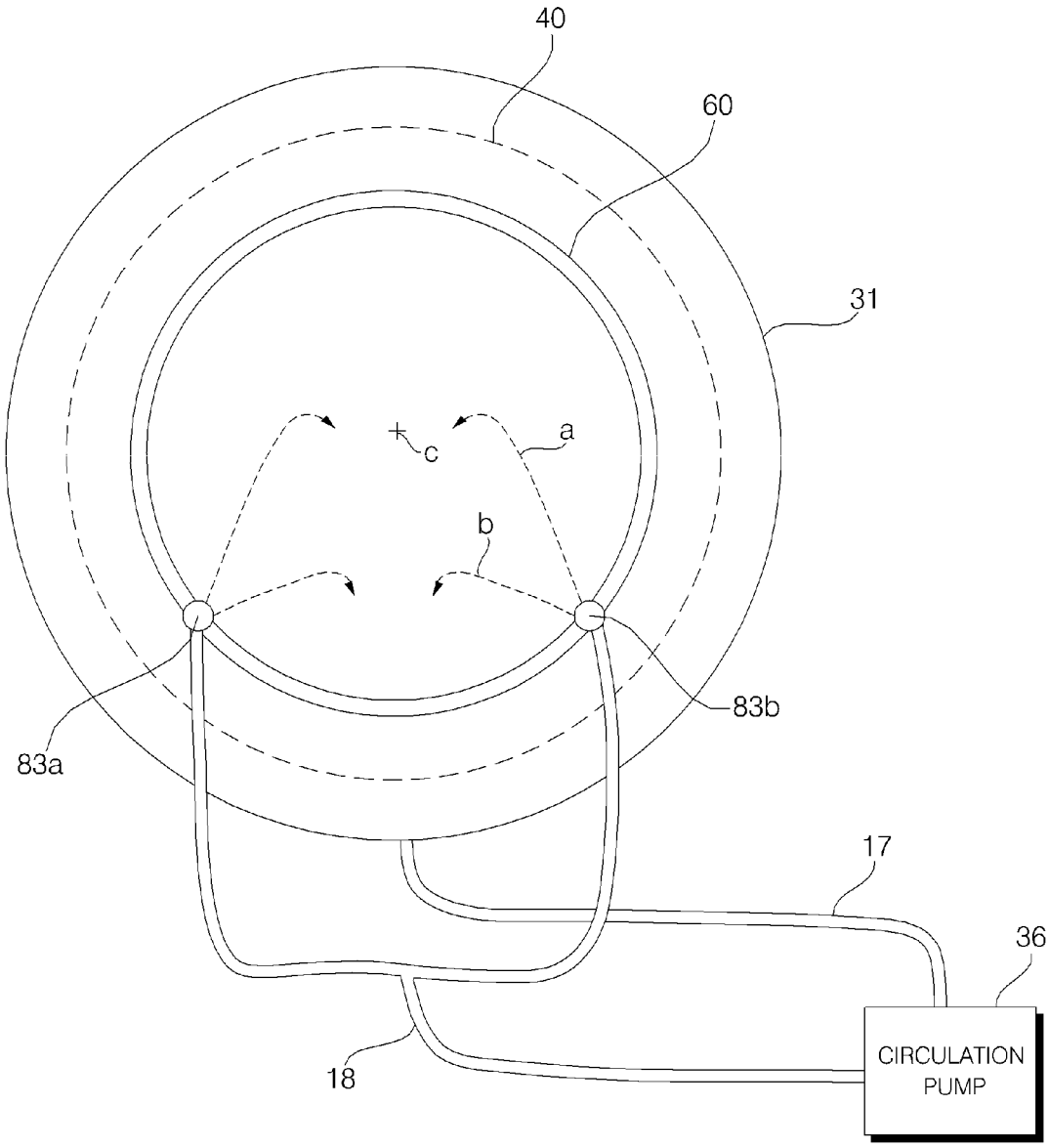
FIG. 4 is a diagram schematically illustrating major components of a washing machine according to an embodiment of the present invention.

FIG. 1 is a perspective view illustrating a washing machine according to an embodiment of the present invention. FIG. 2 is a cross-sectional view illustrating the washing machine illustrated in FIG. 1. FIG. 3 is a block diagram illustrating a control relationship between major components of a washing machine according to an embodiment of the present invention. FIG. 4 is a diagram schematically illustrating major components of a washing machine according to an embodiment of the present invention.

Referring to FIGS. 1 to 4, a casing 10 defines an exterior appearance of a washing machine, and an entry hole 12*h* through which laundry is loaded is formed on a front surface of the casing 10. The casing 10 may include: a cabinet 11 having an opened front surface, a left surface, right surface, and a rear surface; and a front panel 12 coupled to the opened front surface of the cabinet 11. The entry hole 12*h* may be formed on the front panel 12. The cabinet 11 may have an opened bottom surface and an opened top surface, and a horizontal base 15 for supporting the washing machine may be coupled to the bottom surface of the cabinet 11. The casing 10 may further include a top plate 13 covering the opened top surface of the cabinet 11, and a control panel 14 disposed in an upper side of the front panel 12.

The control panel 14 may include an input unit (e.g., a button, a dial, a touch pad, etc.) for receiving various settings regarding operation of the washing machine from a user, and a display unit (e.g., an LCD, an LED display, etc.) for displaying an operation state of the washing machine.

A door 20 for opening and closing the entry hole 12*h* may be rotatably coupled to the casing 10. The door 20 may include: a door frame 21 having an opened portion, approximately at the center thereof, and rotatably coupled to the front panel 12; and a window 22 installed at the opened central portion of the door frame 21.

A tub 31 for containing water may be disposed in the casing 10. An entrance hole is formed on a front surface of the tub 31 to receive laundry, and the entrance hole communicates with the entry hole 12*h* of the casing 10 by the gasket 60.

The gasket 60 serves to prevent leakage of water contained in the tub 31. A front end of the gasket 60 is coupled to the front surface (or the front panel 12) of the casing 10, a rear end of the gasket 60 is coupled to the entrance hole of the tub 31, and a portion between the front end and the rear end extends in a tube shape. The gasket 60 may be formed of a flexible or elastic material. The gasket 60 may be formed of rubber or synthetic resin.

The gasket 60 may include: a casing coupler 61 coupled to a circumference of the entry hole 12*h* of the casing 10; a tub coupler 62 coupled to a circumference of the entrance hole of the tub 31; and a tube-shaped extension part 63 extending from the casing coupler 61 to the tub coupler 62.

The extension part 63 may include: a flat portion 64 evenly extending from the casing coupler 61 toward the tub coupler 62; and a foldable portion 65 formed between the flat portion 64 and the tub coupler 62.

The foldable portion 65 is folded or unfolded when the tub 31 moves in an eccentric direction. The foldable portion 65 may be formed at a part of the circumference of the gasket 60 or formed over the entire circumference of gasket 60.

At least one nozzle 83*a* or 83*b* may be installed in the gasket 60. The at least one nozzle 83*a* or 83*b* is preferably installed in the flat portion 64. According to an embodiment, the at least one nozzle 83*a* or 83*b* may be integrally formed with the flat portion 64, but aspects of the present invention are not limited thereto and a nozzle connection structure (not shown) may be formed in the flat portion 64 such that a nozzle inlet pipe (not shown, a pipe through which water pumped by a circulation pump 36 is introduced) formed separately from the gasket 60 is inserted/fixed to the nozzle connection structure. In either case, it is preferable that an outlet of the at least one nozzle 83*a* or 83*b* for injecting water toward a drum 40 is positioned in an inner area surrounded by the gasket 60, and that a circulating water guide pipe 18 is connected to the inlet pipe in the outside of the gasket 60.

A circumference of the entrance hole of the front panel 12 is rolled outward, and the casing coupler 61 is fitted into a concave portion formed by a circumference of the rolled portion. A ring-shaped groove to be wound by a wire is formed in the casing coupler 61, and the wire is wound around the groove and then both ends of the wire are jointed such that the casing coupler 61 is rigidly fixed to the circumference of the entrance hole of the front panel 12.

The drum 40 in which laundry is accommodated is rotatably provided in the tub 31. A plurality of through holes 47 communicating with the tub 31 may be formed in the drum 40. In addition, a lifter 45 for lifting laundry upon rotation of the drum 40 may be provided on an inner circumferential surface of the drum 40.

The drum 40 is disposed such that the entry hole, through which laundry is loaded, is positioned on the front surface, and the drum 40 rotates around a rotation central line C which is approximately horizontal. In this case, "horizontal" does not refer to the a mathematical definition thereof. That is, even in the case where the rotation central line C is inclined at a predetermined angle relative to a horizontal state, the rotation central line C may be considered approximately horizontal if the rotation central line C is more like in the horizontal state than in a vertical state.

The tub 31 may be supported by a damper 16 installed at the bottom of the casing 10. Vibration of the tub 31 caused by rotation of the drum 40 may be annulated by the damper 16.

There may be provided a water supply hose (not shown) for guiding water supplied from an external water source, such as a water tap, to the tub 31, and a water supply valve 94 for regulating the water supply hose.

A dispenser 35 for providing additives such as detergent and textile softener to the drum 40 may be provided. Additives may be accommodated separately in the dispenser 35 according to types thereof. The dispenser 35 may include a detergent accommodator (not illustrated) for accommodating detergent, and a softener accommodator (not illustrated) for accommodating textile softener.

At least one water supply pipe 34 may be provided to selectively guide water, supplied through a water supply valve 94, to each accommodator of the dispenser 35. The at least one water supply pipe 34 may include a first water supply pipe for supplying water to the detergent accommodator, and a second water supply pipe for supplying water to the textile softener accommodator, and, in this case, the water supply valve 94 may include a first water supply valve for regulating the first water supply pipe, and a second water supply valve 2 for regulating the second water supply pipe.

Meanwhile, the gasket 60 may include a direct water nozzle 57 for injecting water into the drum 40, and a direct water supply pipe 39 for guiding water, supplied through the water supply valve 94, to the direct water nozzle 57. The water supply valve 94 may include a third water supply valve for regulating the direct water supply pipe 39.

Water discharged from the dispenser 35 is supplied to the tub 31 through a water supply bellows 37. A water supply hole (not illustrated) connected to the water supply bellows 37 may be formed in the tub 31. A drain hole for discharging water may be formed in the tub 31, and a drain bellows 17 may be connected to the drain hole. There may be a circulation pump 36 for pumping water, discharged from the drain bellows 17, to the circulating water guide pipe 18.

The circulation pump 36 may include: an impeller (not illustrated) for pumping water; a pump housing (not shown) for housing the impeller; and a circulation pump motor 92 for rotating the impeller. The pump housing may include: an inlet port (not shown) through which water is introduced from the drain bellows 17; and a circulating water discharge port (not shown) which discharges water, pumped by the impeller, to the circulating water guide pipe 18. An entrance hole of the circulating water guide pipe 18 is connected to the circulating water discharge port, and an exit hole thereof is connected to the at least one nozzle 83*a* or 83*b* which will be described later.

If a user inputs a setting (e.g., washing course, washing time, rinsing time, spin-drying time, spin-drying speed, etc.) through the input unit provided on the control panel 14, a controller or a processor 91 controls the washing machine to operate according to the input setting. For example, an algorithm of the water supply valve 94, a washing motor 93, the circulation pump motor 92, a discharge valve 96, and the like according to each course selectable through the input unit may be stored in a memory (not shown), and the processor 91 may perform control such that the washing machine operates according to an algorithm corresponding to a setting input through the input unit.

There may be provided a drain pump 33 for pumping water, discharged from the pump 31, to a drain pipe 19. The drain pump 33 pumps water, introduced through the discharge bellows 17, to the drain pipe 19. The drain pump 33 may include: an impeller (not illustrated) for pumping water; a pump housing (not illustrated) for accommodating the impeller; and a drain pump motor 98 for rotating the impeller. The drain pump motor 98 may be configured substantially identical to the circulation pump motor 92. The pump housing may include: an inlet port (not illustrated) in which water is introduced through the discharge bellows 17; and a discharge port (not illustrated) which discharges water, pumped by the impeller, to the drain pipe 19.

Under control of the processor 91, according to a preset algorithm, the circulation pump 38 (for example, when washing laundry) or the drain pump 33 (for example, when draining water) may operate.

Meanwhile, the circulation pump motor 92 is a variable speed motor whose rotation speed is controllable. The circulation pump motor 92 may be a Brushless Direct Current Motor (BLDC), but aspects of the present invention are not limited thereto. There may be further provided a driver for controlling a speed of the circulation pump motor 92, and the driver may be an inverter driver. The inverter driver inputs a target frequency to the motor by converting AC power into DC power.

The circulation pump motor 92 may be controlled by the processor 91. The processor 91 may include a Proportional-Integral (PI) controller, a Proportional-Integral-Derivative (PID) controller, and the like. The controller may receive an output value (e.g., an output current) of the circulation pump motor 92, and control an output value of the driver so that a rotation speed (or, the number of times of rotation) of the circulation pump motor 92 follows a preset target rotation speed (or, the number of times of rotation) based on the received output value of the circulation pump motor 92.

Meanwhile, the processor 91 may control not just the circulation pump motor 92, but also the drain pump motor 98, and may further control overall operations of the washing machine, and, although not explicitly mentioned, it is understood that each component described hereinafter is controlled by the processor 91.

There may be provided at least one nozzle 83*a* and 83*b* for spraying circulating water, pumped by the circulation pump 36, into the drum 40. In the embodiment, nozzles 83*a* and 83*b* disposed on both the left side and the right side of the gasket 60 under the center C of the drum 40 spray water in an upward direction, but aspects of the present invention are not necessarily limited thereto. That is, the number of nozzles and the positions thereof may vary, but, in any case, the washing machine according to an embodiment of the present invention preferably include at least one nozzle 83*a* or 83*b* that sprays water further upward as the pressure of supplied water increases (that is, as discharge pressure, a discharge flow rate, a rotation speed, or the number of times of rotation of the circulation pump 36 increases).

An exit hole of each of the nozzles 83*a* or 83*b* may be opened upward in a direction inward the drum 40. Thus, when water of predetermined pressure or greater is supplied, water sprayed through each of the nozzles 83*a* or 83*b* may be in an upward inclined direction toward the inside of the drum 40 such that the sprayed water reaches a region deep inside the drum 40.

Meanwhile, when pressure of water supplied to the at least one nozzle 83*a* or 83*b* is not sufficient, water sprayed through the exit hole of the at least one nozzle 83*a* or 83*b* is not allowed to be sprayed upward enough and easily falls by gravity, ended up with failing to reach a region deep inside the drum 40.

In FIG. 4, a form of injecting water supplied by the circulation pump 36 with sufficient pressure is indicated by "a", and a form of injecting water with pressure lower than the sufficient pressure is indicated by "b". That is, as a rotation speed of the circulation pump 36 varies, the form of a water stream injected through the at least one nozzle 83*a* or 83*b* may vary between a (high-speed rotation) and b (low-speed rotation).

Figure 5:
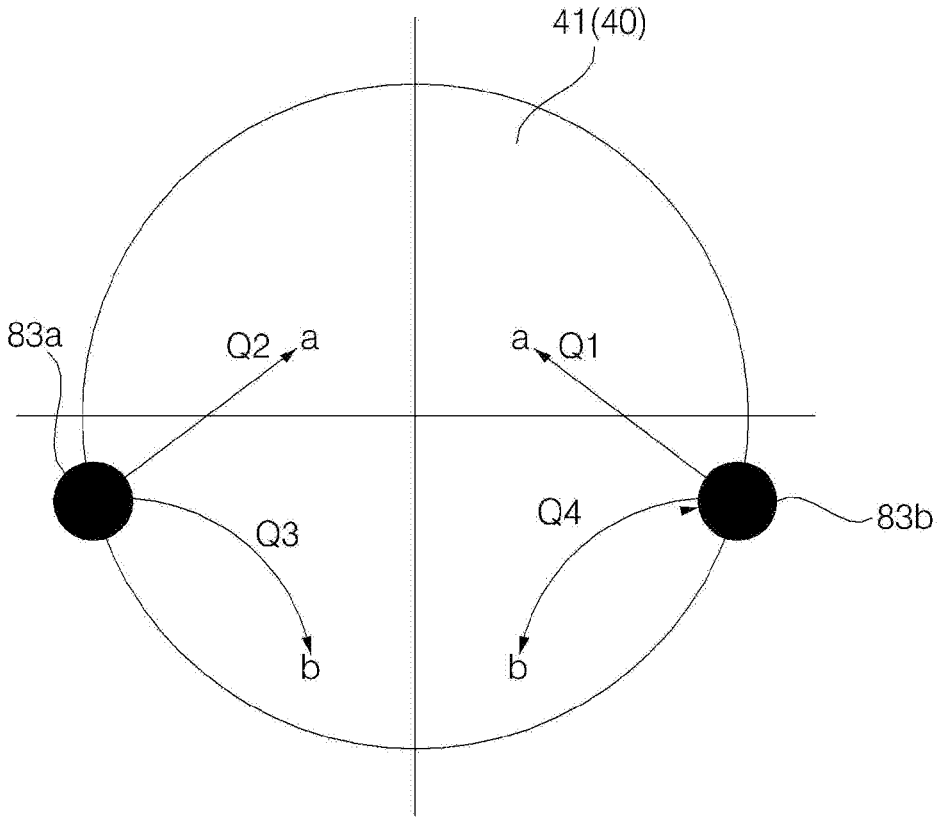
FIG. 5 schematically illustrates a front view of a drum, in which a spray range of each nozzle is illustrated.
Figure 6:
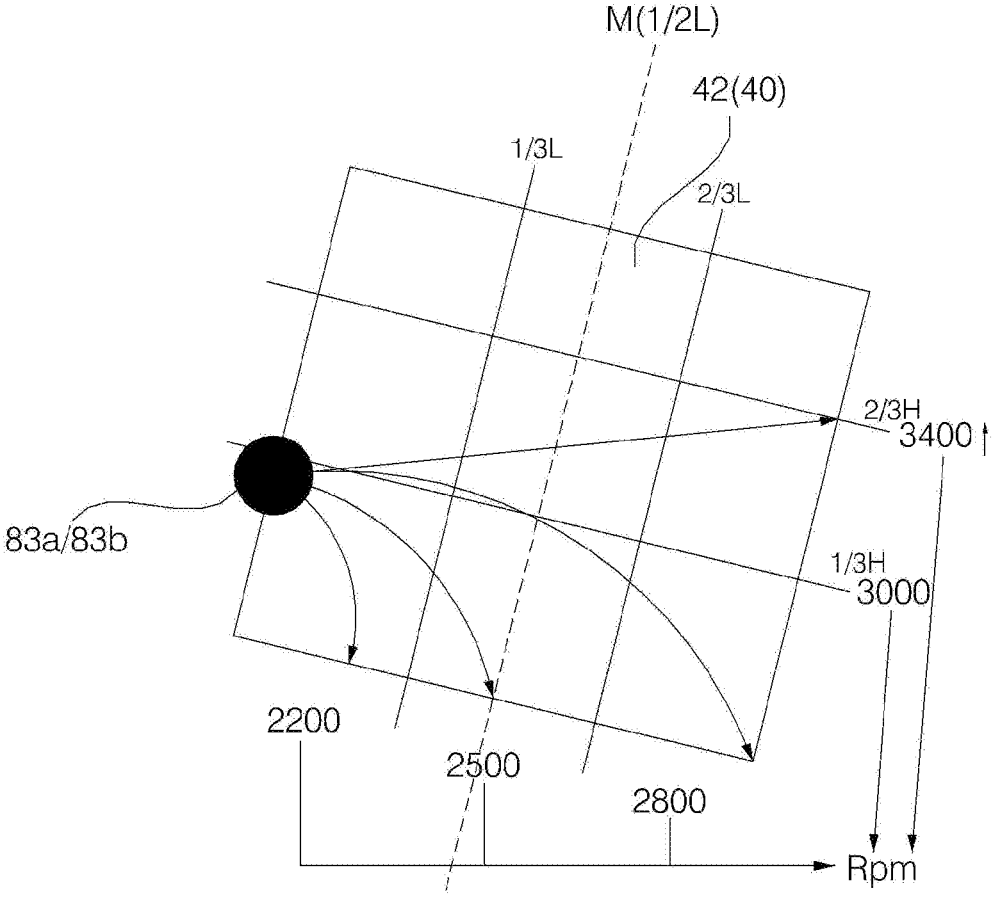
FIG. 6 schematically illustrates a side view of a drum, in which a spray range of each nozzle is illustrated.

FIG. 5 schematically illustrates a front view of a drum, in which a spray range of each nozzle is illustrated. FIG. 6 schematically illustrates a side view of a drum, in which a spray range of each nozzle is illustrated.

Referring to FIG. 5, quadrants Q1, Q2, Q3, and Q4 are defined by dividing the drum 40 into four, when viewed from a front side of the drum. A first nozzle 83*a* is disposed in a third quadrant Q3, and a second nozzle 83*b* is disposed in a fourth quadrant Q4. In FIG. 5, a lower limit b of a water stream sprayed through each of the nozzles 83*a* and 83*b* represents the case where the circulation pump motor 92 rotates at 2600 rpm, and an upper limit a of water sprayed through each of the nozzles 83*a* and 83*b* represents the case where the circulation pump motor 92 rotates at 3000 rpm.

The first nozzle 83*a* serves to spray water into a region ranging from the third quadrant Q3 and to the second quadrant Q2 according to a rotation speed of the circulation pump motor 92. That is, as a rotation speed of the circulation pump motor 92 increases, water is sprayed gradually further upward through the first nozzle 83*a*, and, if the circulation pump motor 92 rotates at the highest speed, a water stream sprayed from the first nozzle 83*a* reaches up to the second quadrant Q2 of a rear surface 41 of the drum 40.

The second nozzle 83*b* serves to spray water into a region ranging the fourth quadrant Q4 and the first quadrant Q2 according to a rotation speed of the circulation pump motor 92. That is, as a rotation speed of the circulation pump motor 92 increases, water is sprayed gradually further upward through the second nozzle 83*b*, and, if the circulation pump motor 92 rotates at the highest speed, a water stream sprayed from the second nozzle 83*b* reaches up to the first quadrant Q2 on the rear surface 41 of the drum 40.

Referring to FIG. 6, a first region, a second region, and a third region are defined as three divided regions of the drum 400, when viewed from a lateral side of the drum. As a rotation speed of the circulation pump motor 92 increases gradually, a water stream sprayed from at least one nozzle 83*a* or 83*b* reaches a region deeper inside the drum 40. As illustrates in the example of the drawing, if the rotation speed of the circulation pump motor 92 is 2200 rpm, a water stream sprayed from the at least one nozzle 83*a* or 83*b* reaches a first region (0~⅓L) on an inner circumferential surface 42 of the drum 40; if the rotation speed of the circulation pump motor 92 is 2500 rpm, the water stream sprayed from the at least one nozzle 83*a* or 83*b* reaches a second region (⅓L~⅔L); if the rotation speed of the circulation pump motor 92 is 2800 rpm, the water stream sprayed from the at least one nozzle 83*a* or 83*b* reaches a third region (⅔L~L). If the rotation speed of the circulation pump motor 92 increases further, the water stream may reach the rear surface 41 of the drum 40. If the rotation speed is 300 rpm, the water stream reaches one third of the height H of the drum 40; if the rotation speed is 3400 rpm, the water stream reaches two third of the height H of the drum 40; and if the rotation speed is 3400 rpm, the water stream reaches the available maximum height, and the water stream is not allowed to reach further upward of the available maximum height due to the structure of the at least one nozzle 83*a* or 83*b*, ended up with increasing only intensity of the water stream.

Figure 7:
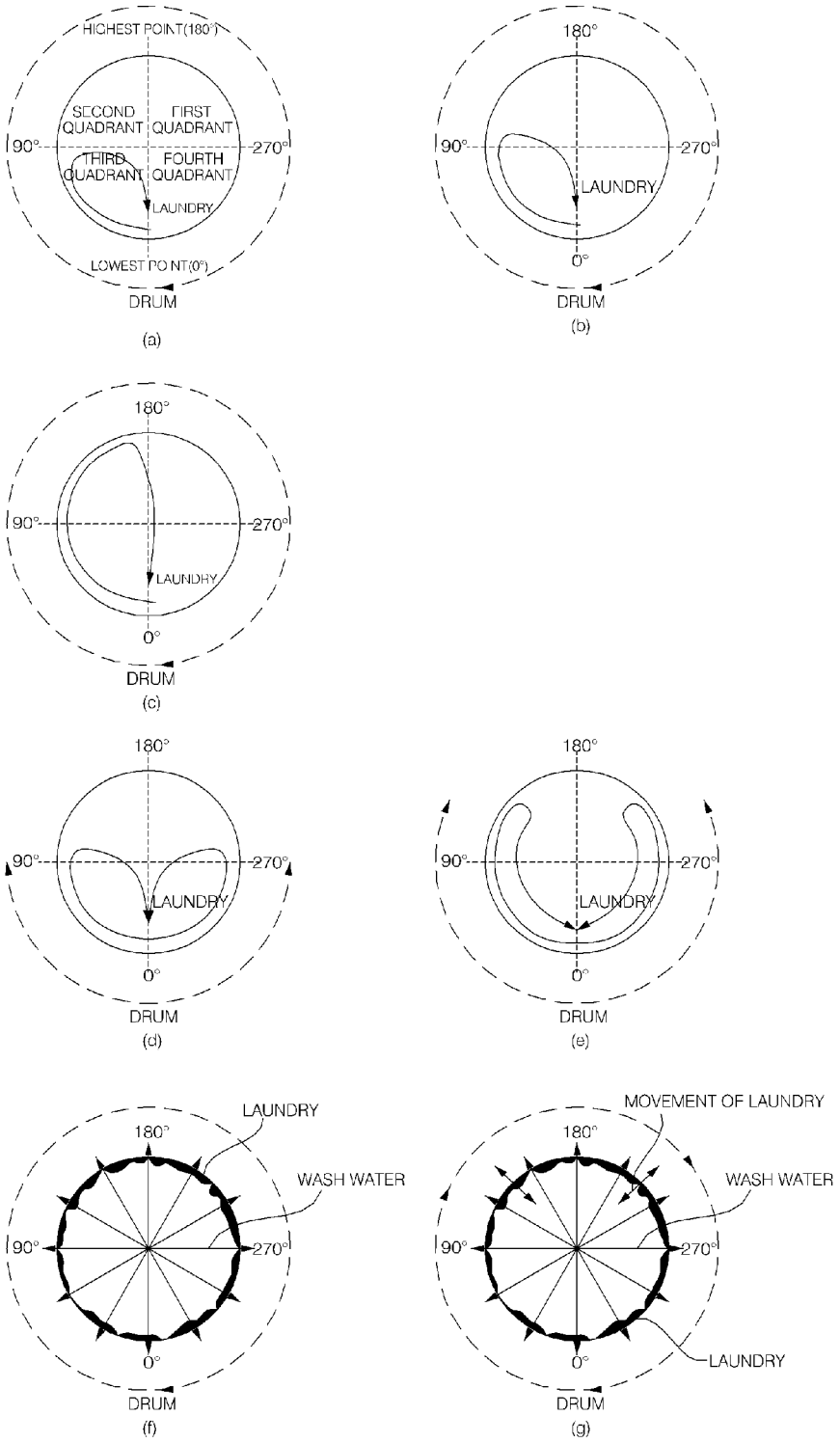
FIG. 7 is a diagram illustrating drum driving motions implementable by a washing machine according to an embodiment of the present invention.

FIG. 7 is a diagram illustrating drum driving motions implementable by a washing machine according to an embodiment of the present invention. Hereinafter, the drum driving motions will be described in detail with reference to FIG. 7.

A drum driving motion refers to a combination of a rotation direction and a rotation speed of the drum 40. A falling direction and a falling time of laundry accommodated in the drum may change According to a drum driving motion, and accordingly movement of the laundry in the drum 40 may change. The drum driving motion may be implemented as a washing motor 93 is controlled by the processor 91.

Since the laundry is lifted by the lifter 45 provided on the inner circumferential surface of the drum 40 upon rotation of the drum 40, an impact to be applied to the laundry may be varied by controlling a rotation speed and a rotation direction of the drum 40. That is, a mechanical force such as a frictional force between laundry items, a frictional force between laundry and wash water, and a falling impact on the laundry may be changed. In other words, an extent of pounding or rubbing the laundry for washing may be varied, and an extent of dispersing or turning upside down of the laundry may be varied.

In the meantime, in order to implement these various drum motions, it is preferable that the washing motor 93 is a direct drive motor. That is, a configuration of the motor is preferable in which a stator of the motor is fixedly secured to a rear of the tub 31, and a driving shaft 38 rotating along with a rotor of the motor directly drives the drum 40. It is because the direct drive motor facilitates control the rotation direction and torque of the motor so that the drum driving motion may be controlled promptly without a delay time or a backlash.

However, if the washing machine has a configuration in which a torque from the motor is transmitted to the driving shaft through a pulley and the like, it is allowed to implement a drum driving motion such as a tumbling motion and a spinning motion, which does not matter with the delay time or the backlash, but this configuration is not appropriate to implement other various drum driving motions. A method for driving the washing motor 93 and the drum 40 is obvious for those skilled in the art, and thus detailed description thereof is herein omitted.

In FIG. 7, (a) is a diagram illustrating a rolling motion. The rolling motion is a motion in which the washing motor 93 rotates the drum 40 in one direction (preferably one or more times of rotation) and makes laundry on the inner circumferential surface of the drum 40 to fall from a point at an angle less than 90 degrees in the rotation direction of the drum 40. In this case, the laundry falls to a lowest point in the drum 40.

For example, if the washing motor 93 rotates the drum 40 at about 40 rpm, laundry at the lowest point in the drum 40 is lifted to a predetermined height in the rotation direction of the drum 40 and falls to the lowest point in the drum 40 from a predetermined point at less than 90 degrees from the lowest point in the drum 40 in the rotation direction as if the laundry rolls. It appears that the laundry keeps rolling at the third quadrant 3Q of the drum 40 when the drum 40 rotates in a clockwise direction.

In the rolling motion, the laundry is washed by friction with the wash water, friction between the laundry, and friction with the inner circumferential surface of the drum 40. In this case, the motion causes an adequate turning upside down of the laundry, thereby providing an effect of softly rubbing the laundry.

Here, it is preferable that a rotation speed rpm of the drum 40 is determined in relation to a radius of the drum 40. That is, the greater the RPM of the drum 40, the stronger the centrifugal force on the laundry in the drum 40. A difference between the centrifugal force and the gravity makes movement of the laundry different. Of course, the rotation force of the drum 40 and the friction between the drum 40 and the laundry, and the RPM of the drum 40 should be taken into consideration as well. A rotation speed of the drum 40 in the rolling motion is determined such that a sum of various forces, such as a frictional force and a centrifugal force, applied to laundry is weaker than gravity 1 G.

In FIG. 7, (b) is a diagram illustrating a tumbling motion. The tumbling motion is a motion in which the washing motor 93 rotates the drum 40 in one direction (preferably, one or more times of rotation) and makes the laundry on the inner circumferential surface of the drum 40 to fall from a point at about 90 to 110 degrees in the rotation direction of the drum 40 to the lowest point in the drum 40. The tumbling motion is a drum driving motion generally used in washing and rinsing since a mechanical force is generated only when the drum 40 is controlled to rotate in one direction at a proper rotation speed.

Laundry loaded into the drum 40 is positioned at the lowest point in the drum 40 before the motor 140 is driven. When the washing motor 93 provides a torque to the drum 40, the drum 40 rotates, making the lifter 45 provided on the inner circumferential surface of the drum 40 to lift the laundry from the lowest point in the drum 40. For example, if the washing motor 93 rotates the drum 40 at about 46 rpm, the laundry falls from a point at about 90 to 110 degrees in the rotation direction from the lower point of the drum 40.

In the tumbling motion, the rotation speed of the drum 40 may be determined such that the tumbling motion generates the centrifugal force stronger than the centrifugal force of the rolling motion but weaker than the gravity.

The tumbling motion appears such that the laundry is lifted from the lowest point in the drum 40 to a point at 90 degrees from the lowest point or up to the second quadrant Q2, and falls therefrom as separating away from the inner circumferential surface of the drum 40.

Accordingly, in the tumbling motion, the laundry is washed by friction of the laundry with the wash water and an impact caused by falling of the laundry, and especially by a mechanical force stronger than the mechanical force occurring in the rolling motion. In particular, the tumbling motion has an effect of disentangling and dispersing the laundry.

In FIG. 7, (c) is a diagram illustrating a step motion. The step motion is a motion in which the motor 140 rotates the drum 40 in one direction (preferably, complete one time of rotation) and makes the laundry on the inner circumferential surface of the drum 40 to fall from a highest point of the drum 40 (preferably, a point at about 146 to 161 degrees from the lowest point in the drum 40, but not limited thereto, or a point at which the drum 40 is rotated greater than 161 degrees but smaller than 180 degrees (for example, a point rotated 180 degrees)).

That is, the step motion is a motion in which the drum 40 rotates at a speed at which the laundry is prevented from falling from the inner circumferential surface of the drum 40 owing to the centrifugal force (that is, a speed at which the laundry rotates along with the drum 40 while stuck to the inner circumference surface of the drum 40 owing to the centrifugal force), and the dram 40 is suddenly braked, thereby maximizing an impact on the laundry.

For example, if the washing motor 93 rotates the drum 40 at a speed over about 60 rpm, the laundry may rotate without falling owing to the centrifugal force (that is, rotating along with the drum 40 while stuck to the inner circumferential surface of the drum 40), and, in this course, if the laundry is lifted by the rotation of the drum 40 to reach a predetermined height, a torque of a direction opposite to the rotation direction of the drum 40 may be controlled to be applied to the washing motor 93.

In the step motion, compared to other motions, laundry is lifted to the highest point from the lowest point in the drum 40 by rotation of the drum 40 and then suddenly falls due to braking of the drum 40, maximizing a falling impact on the laundry. Therefore, a mechanical force (for example, an impact force) generated by the step motion is generally stronger than the mechanical force generated by the rolling motion or the tumbling motion.

The step motion appears such that, when the drum 40 rotates in a clockwise direction, the laundry moves to a predetermined height (for example, the highest point (180 degrees) of the drum 40) from the lowest point in the drum 40 via the third quadrant 3Q and the second quadrant 2Q, and is then suddenly separated from the inner circumferential surface of the drum 40, falling to the lowest point in the drum 40. Thus, the step motion provides a mechanical force to the laundry more effectively as an amount of the laundry is smaller.

In the meantime, reversing-phase braking is preferable for the motor 140 to brake the drum 40 in the step motion. The reversing-phase braking is a motor braking method in which a rotation force in a direction opposite to the current rotation direction of the washing motor 93 is generated to brake the washing motor 93. In order to generate the rotation force in a direction opposite to the current rotation direction of the washing motor 93, a phase of the current being supplied to the washing motor 93 may be inverted and accordingly the sudden braking is made in this manner.

The step motion is a motion in which the laundry is washed by friction between the drum 40 and the laundry while the drum rotates, and by the impact of falling of the laundry and turning the laundry upside down when the drum 40 is braked.

In FIG. 7, (d) is a diagram illustrating a swing motion. The swing motion is a motion in which the washing motor 93 rotates the drum 40 bidirectionally, and makes the laundry to fall from a point about less than 90 degrees (preferably, a point rotated about 30 to 45 degrees in the rotation direction of the drum 40, but not limited thereto, and possibly a point rotated greater than 45 degrees and smaller than 90 degrees)

in the rotation direction of the drum 40. For example, if the washing motor 93 rotates the drum 40 in the counter-clockwise direction at about 40 rpm, the laundry at the lowest point in the drum 40 is lifted to a predetermined height in the counter-clockwise direction. In this case, the washing motor 93 stops the rotation of the drum 40 before the laundry reaches about a point rotated about 90 degrees in the counter-clockwise direction such that the laundry falls to the lowest point in the drum 40 from a point about less than 90 degrees in the counter-clockwise direction.

After the rotation of the drum 40 is stopped, the washing motor 93 rotates the drum 40 in a clockwise direction at about 40 rpm, lifting the laundry to a predetermined height along the rotation direction of the drum 40 (that is, a clockwise direction). Then, the washing motor 93 is controlled to stop rotating the drum 40 before the laundry reaches about a 90-degree point in the clockwise direction, making the laundry fall or roll down to the lowest point in the drum 40 from a point at about less than 90 degrees in the clockwise direction.

That is, the swing motion is a motion in which forward rotation and stopping of the drum 40 and backward rotation and stopping of the drum 40 are repeated, and it appears that the laundry repeats a motion in which the laundry is lifted from the lowest point to the second quadrant 2Q of the drum 40 via the third quadrant 3Q and falls therefrom softly, and then, the laundry is lifted to the first quadrant 1Q via the fourth quadrant 4Q of the drum 40 and falls therefrom softly. That is, the swing motion appears such that the laundry makes a motion which looks like a laid down character 8 over the third quadrant 3Q and the fourth quadrant Q4 of the drum 40.

In this case, rheostatic braking is adequate to brake the washing motor 93. The rheostatic braking may minimize a load on the washing motor 93 and mechanical wear of the washing motor, and control an impact being applied to the laundry.

The rheostatic braking is a braking method which uses a generator like action of the washing motor 93 owing to rotation inertia thereof when a current to the motor is turned off. If the current to the motor is turned off, a direction of the current to the coil of the washing motor 93 becomes opposite to a direction of the current before the power is turned off, and thus, a force (Fleming's right hand rule) acts in a direction which interferes the rotation of the washing motor 93, thereby braking the washing motor 93. Unlike the reversing-phase braking, the rheostatic braking does not make sudden braking of the washing motor 93, but makes a smooth change of the rotation direction of the drum 40.

In FIG. 7, (e) is a diagram illustrating a scrub motion. The scrub motion is a motion in which the washing motor 93 rotates the drum 40 bidirectionally and makes the laundry fall from beyond about 90 degrees in the rotation direction of the drum 40.

For example, if the washing motor 93 rotates the drum 40 in a forward direction at a speed of about 60 rpm or higher, the laundry is lifted from the lowest point in the drum 40 to a predetermined height in the forward direction. In this case, when the laundry reaches a point corresponding to a set angle of about 90 degrees or more (preferably, an angle of 139 to 150 degree, but not limited thereto, and possibly an angle of 150 degrees or more) in the forward direction, the washing motor 93 provides a reverse torque to the drum 40, thereby stopping the rotation of the drum 40 temporarily. Then, the laundry stuck to the inner circumferential surface of the drum 40 falls suddenly.

Then, the washing motor 93 rotates the drum 40 at a speed of about 60 RPM or more in the backward direction, thereby lifting the fallen laundry to a predetermined height of 90 degrees or more in the backward direction. When the laundry reaches a point corresponding to the set angle of 90 degrees or more (for example, an angle of 139 to 150 degrees) in the backward direction, the washing motor 93 provides a reverse torque to the drum 40 again, thereby stopping the rotation of the drum 40 temporarily. In this case, the laundry stuck to the inner circumferential surface of the drum 40 falls from a point of 90 degrees or more in the backward direction.

The scrub motion enables washing the laundry by making the laundry fall suddenly from a predetermined height. In this case, it is preferable that the washing motor 93 is reverse-phrase braked so as to brake the drum 40.

Since the rotation direction of the drum 40 is suddenly changed, the laundry is not separated away from the inner circumferential surface of the drum 40 to a great extent, and thus, the scrub motion may have a powerful rubbing effect of washing.

For example, the scrub motion is a repetitive motion in which the laundry moves to the second quadrant via the third quadrant, falls therefrom suddenly, moves to the first quadrant via the fourth quadrant, and falls therefrom suddenly. Therefore, the scrub motion appears that the laundry repeatedly moves up and down.

In FIG. 7, (f) is a diagram illustrating a filtration motion. The filtration motion is a motion in which the washing motor 93 rotates the drum 40 with preventing the laundry from being separated from the inside circumferential surface of the drum 40, while the wash water is sprayed through at least one nozzle 83*a* or 83*b* to the inside of the drum 40.

Since the wash water is sprayed to the inside of the drum 40 while the laundry is dispersed and rotates in close contact with the inner circumferential surface of the drum 40, the wash water penetrates the laundry owing to the centrifugal force and is then discharged to the tub 31 through the through holes 47 of the drum 40.

Since the filtration motion makes the wash water to penetrate the laundry while enlarging a surface area of the laundry, the laundry is uniformly soaked.

In FIG. 7, (g) is a diagram illustrating a squeeze motion. The squeeze motion is a motion in which the washing motor 93 repeats an operation of rotating the drum 40 such that the laundry does not fall from the inner circumferential surface of the drum 40 and reducing the rotation speed of the drum 40 such that the laundry is separated from the inner circumferential surface of the drum 40, while the wash water is sprayed into the drum 40 through at least one nozzle 83*a* or 83*b* during the rotation of the drum 40.

That is, the squeeze motion is different from the filtration motion in that, while, in the filtration motion, the laundry is rotated at a speed at which the laundry is not separated away from the inner circumferential surface of the drum 40, in the squeeze motion, the drum 40 repeats acceleration and deceleration of the drum such that laundry repeats being stuck to and separated from the inner circumferential surface.

Figure 8:
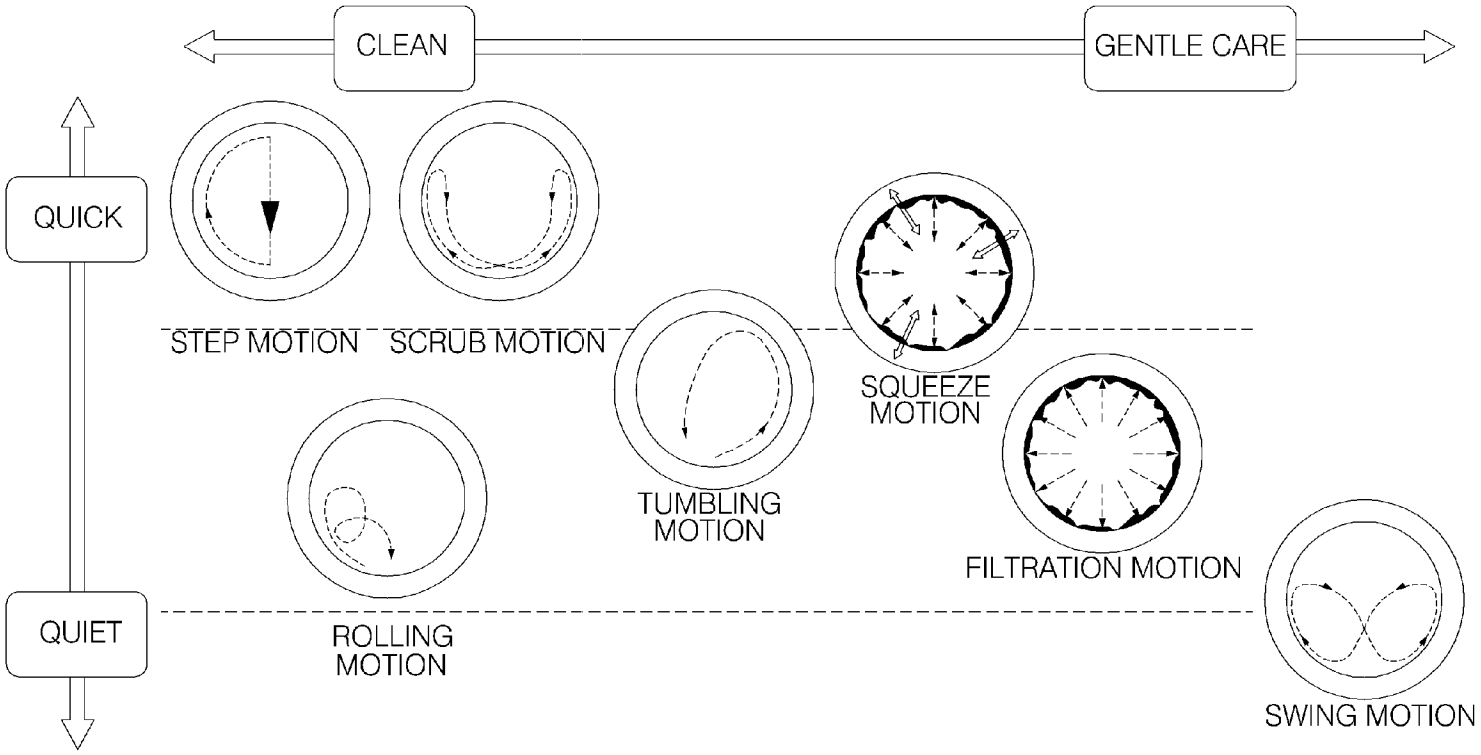
FIG. 8 is a graph for comparison in washing performance and a degree of vibration between drum driving motions.

FIG. 8 is a graph for comparison in washing performance and a degree of vibration between drum driving motions. In FIG. 8, a horizontal axis represents washing performance, and contaminants included in laundry may be more easily separated toward a leftward direction of the horizontal axis. The vertical axis represents a degree of vibration and a noise level, and the degree of vibration increases toward an upward direction of the vertical axis while a time required to wash the same laundry decreasing toward the upward direction of the vertical axis.

The step motion and the scrub motion are motions appropriate for a washing course selected when laundry is contaminated a lot and when a washing time needs to be reduced. In addition, the step motion and the scrub motion are motions that results in a high degree of vibration and a high noise level. Therefore, the step motion and the scrub motion are not preferable motions for a washing course selected when laundry is sensitive clothes or when noise and vibration need to be minimized.

The rolling motion is a motion characterized by excellent washing performance, a low degree of vibration, a minimized possibility of damage to laundry, and a low motor load. Thus, the rolling motion is applicable to every washing course, and especially appropriate in dissolving detergent and soaking laundry in the initial washing stage. However, the rolling motion generates a low degree of vibration but takes a longer time to wash laundry to a particular level, compared to the tumbling motion.

The tumbling motion has a low washing performance than that of the scrub motion, but a degree of vibration thereof is between a degree of vibration of the scrub motion and a degree of vibration of the rolling motion. The tumbling motion is applicable to every washing course, and especially useful for a step of dispersing laundry.

The squeeze motion has a washing performance similar to that of the tumbling motion, and a degree of vibration thereof is higher than that of the tumbling motion. In the squeeze motion, wash water penetrates laundry and is discharged to the outside of the drum 40 in the procedure in which the laundry repeats stuck to and being separated from the inner circumferential surface of the drum 40, and therefore, the squeeze motion is useful for a step of rinsing or a step of providing wash water to the laundry.

The filtration motion has a washing performance lower than that of the squeeze motion and a noise level similar to that of the rolling motion. In the filtration motion, wash water penetrates laundry and is discharged to the tub 31 while the laundry is stuck to the inner circumferential surface of the drum 40, and therefore, the filtration motion is useful for a step of soaking the laundry or a step of providing wash water to the laundry in the initial washing stage.

The swing motion is a motion having the lowest degree of vibration and the lowest washing performance. Therefore, the swing motion is a motion useful for a low-noise or low-vibration washing course and for gentle care which means washing sensitive clothes.

Figure 9:
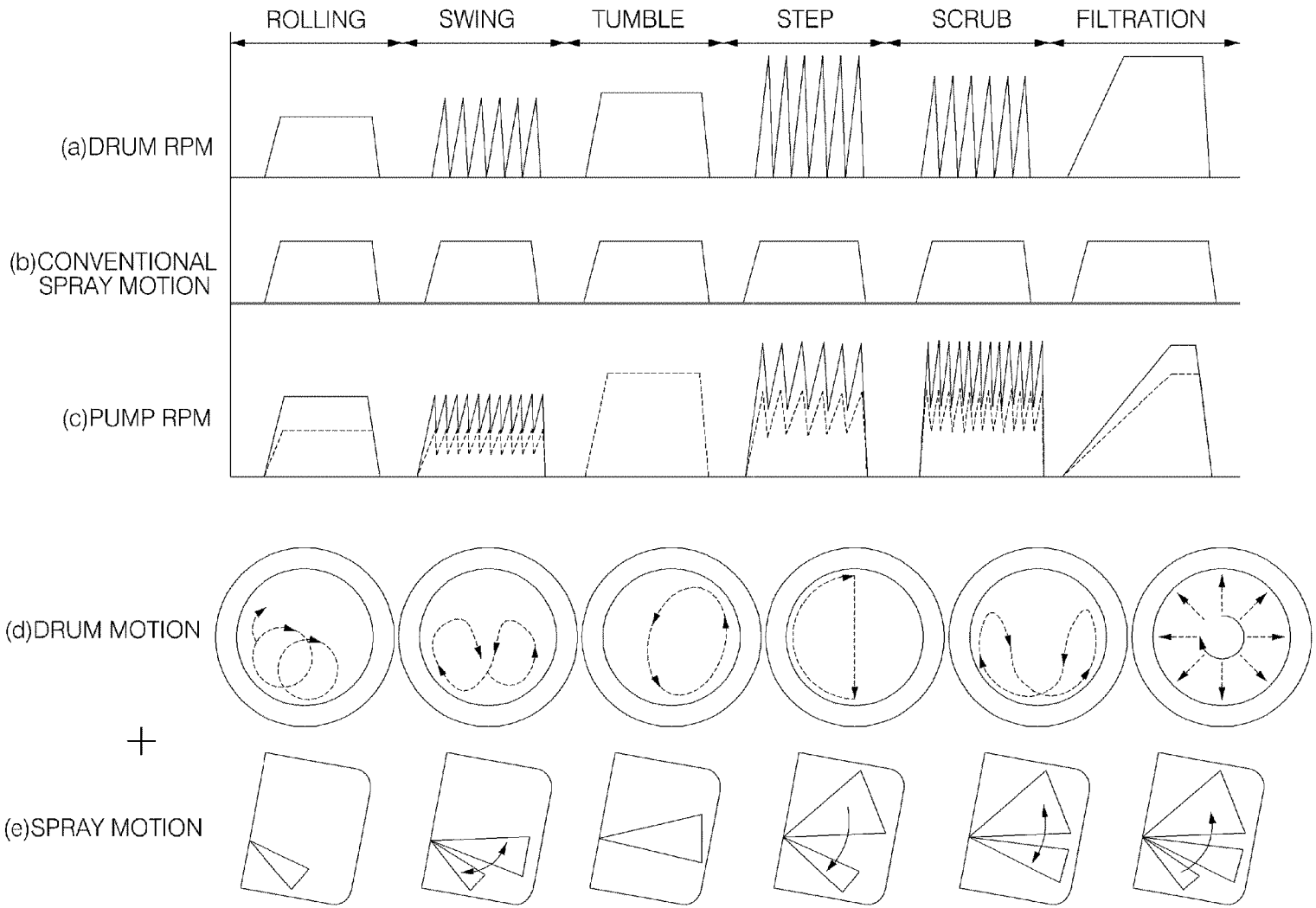
FIG. 9 is a diagram for explanation of a spray motion in each drum driving motion of the present invention compared with an existing motion.

FIG. 9 is a diagram for explanation of a spray motion in each drum driving motion of the present invention compared with an existing motion. In FIG. 9, (a) is a graph illustrating a rotation speed of the drum 40 or the washing motor 93 in each drum driving motion, (b) is a graph illustrating a rotation speed of a circulation pump motor in each drum driving motion in an existing washing machine having a constant speed pump, (c) is a graph illustrating a rotation speed of the circulation pump motor 92 in each drum driving motion in a washing machine according to an embodiment of the present invention, and (e) illustrates a spray form (hereinafter, referred to as a "spray motion") through at least one nozzle 83*a* or 83*b* in each drum driving motion in a washing machine according to an embodiment of the present invention.

Referring to FIG. 9, since the existing washing machine is not capable of varying a speed of the circulation pump motor, the existing washing machine has no choice except rotating the circulation pump motor at a constant speed all the time even though a drum driving motions changes. Thus, the existing washing machine is not able to effectively respond to movement of laundry caused according to a type of a drum driving motion, by using a water stream sprayed through a nozzle, and there are difficulties in managing power consumption, washing performance, and soaking laundry. The present invention aims to solve these problems by appropriately controlling the rotation speed of the circulation pump motor 92 according to a drum driving motion and furthermore taking a laundry load into consideration in this course.

In particular, in the case of a drum driving motion in which laundry is lifted while stuck to an inner circumferential surface 42 of the drum 40 and, when reaching a predetermined height, separated away from the inner circumferential surface 42 due to braking of the drum 40 and thereby falls therefrom (hereinafter, referred to as "falling trigger motion by braking": for example, the swing motion, the step motion, or the scrub motion), a rotation speed of the circulation pump motor 92 may be controlled to vary within a predetermined speed range. That is, the circulation pump motor 92 may be controlled to repeat an operation of accelerating to the upper limit of the speed range and decelerating to the lower limit of the speed range.

A range in which the rotation speed of the circulation pump motor 92 is varied while the falling trigger motion by braking is in execution may be set according to a laundry load.

In a section in which the circulation pump motor 92 is controlled to rotate at a constant speed in the rolling motion, the tumbling motion, and the filtration motion, the rotation speed of the circulation pump motor 92 may be set according to a laundry load.

Meanwhile, referring to (c) of FIG. 9, RPM of the circulation pump motor 92 may be controlled in a different manner in the rolling motion, the swing motion, the step motion, the scrub motion, and the filtration motion. In the drawing, RPM of the circulation pump motor 92 in response to a large laundry load is indicated with a solid line, and RPM of the circulation pump motor 92 in response to a small laundry load is indicated with a dotted line. In the case of the tumbling motion, RPM of the circulation pump motor 92 may be controlled in a manner which is identical regardless of a laundry load.

In each drum driving motion illustrated in FIG. 9, operation of the washing motor 93 and operation of the circulation pump motor 92 are linked to each other. Hereinafter, a method for controlling the washing motor 92 and the circulation pump motor 92 will be described with reference to FIG. 10. In FIG. 9, A1 to A6 illustrates steps of controlling the washing motor 93, and B1 to B6 illustrates steps of controlling the circulation pump motor 92.

While a washing machine operates, if a preset drum driving motion starts, the processor 91 controls the washing motor 93 and the circulation pump motor 92 according to a method set for each drum driving motion.

Specifically, the processor 91 initiates driving of the washing motor 93 (A1), and accelerates the washing motor 93 (A2). There may be provided a sensor for sensing a rotation angle of the drum 40, and, if the rotation angle of the drum 40 sensed by the sensor reaches a predetermined value θ (hereinafter, referred to as a "motion angle") (A3), the processor 91 may perform control to decelerate the washing motor 93 (A4).

In the rolling motion, the tumbling motion, and the filtration motion, the drum 40 may consecutively rotate once or more, and, in this case, the motion angle θ has a value of 360 degrees or more.

On the contrary, in a falling trigger motion by braking, such as the swing motion, the step motion, and the scrub motion, the motion angle θ may be set to an appropriate value within a range of 180 degrees according to characteristics of each corresponding drum driving motion. For example, the motion angle θ may be 30 to 45 degrees in the swing motion, 146 to 161 degrees in the step motion, and 139 to 150 degrees in the scrub motion.

When the drum 40 is decelerated to stop, the drum driving motion is completed once, and then the drum driving motion is performed again (A5). Steps A2 to A5 are repeatedly performed until the number of times the drum driving motion is performed reaches a preset number of times, and, when the number of times the drum driving motion is performed reaches the preset number of times, operation of the washing motor 93 is stopped (A6).

Meanwhile, when driving of the washing motor 93 is initiated in the step A1, the processor 91 applies a start signal SG1 to the circulation pump motor 92 and driving of the circulation pump motor 92 is initiated in response to the start signal SG1 (B1). Then, based on motion information (that is, information on the currently implementing drum driving motion), the processor 91 accelerates the circulation pump motor 92 according to a setting that is set for each drum driving motion (B2).

Meanwhile, in the step S3, when the rotation angle of the drum 40 reaches the motion angle θ, the processor 91 applies an angle control completion signal SG2 to the circulation pump motor 92.

In the case of the falling trigger motion by braking, in response to the angle control completion signal SG2, the rotation speed stops from being accelerated (or the circulation pump motor 92 is braked) after the rotation speed reaches an upper limit value Pr(V, H) set for each drum driving motion, and then the rotation speed is decelerated (B4, B5) according to a setting that is set for each drum driving motion.

Then, when the driving of the washing motor 92 is initiated again in the step A5, the processor 91 applies a restart signal SG3 to the circulation pump motor 92. In response to the restart signal SG3, the circulation pump motor 92 stops decelerating the rotation speed when the rotation speed reaches a lower limit value Pr(V, L) set for each drum driving motion (B5), and repeats the steps B2 to B5.

Meanwhile, in the case of the rolling motion, the tumbling motion, or the filtration motion, at a time when the angle control completion signal SG2 is applied to the circulation pump motor 92, the circulation pump motor 92 is rotating with maintaining a rotation speed set for each corresponding drum driving motion. Thus, in the above-mentioned motions, the circulation pump motor 92 is decelerated (B4) in response to the angle control completion signal SG2.

Meanwhile, in any drum driving motion, when the washing motor 93 stops in the step A6, the processor 91 applies a stop signal SG4 to the circulation pump motor 92, and the circulation pump motor 92 stops in response to the stop signal SG4.

Figure 11:
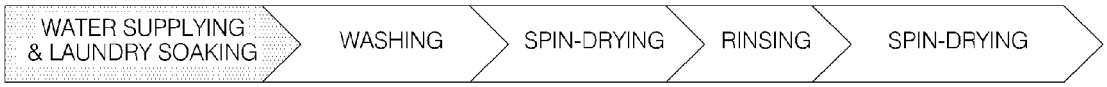
FIG. 11 illustrates the entire washing order applicable to a washing machine of the preset invention.

As illustrated in FIG. 11, a washing machine may be configured to implement a water supplying/laundry soaking cycle, a washing cycle, a spin-drying cycle, a rinsing cycle, and a spin-drying cycle in a sequence. The water supplying/laundry soaking cycle is a cycle for soaking laundry with supplying water with detergent.

The washing cycle is a cycle for removing contaminants from laundry by rotating the drum 40 according to a preset algorithm, and the rolling motion or the tumbling motion may be implemented during the washing cycle.

The spin-drying cycle is a cycle for removing moisture from laundry by rotating the drum 40 at a high speed. While the drum 40 rotates, the drain pump 33 may operate.

The rinsing cycle is a cycle for removing detergent from laundry. During the rinsing cycle, water is supplied and the rolling motion or the tumbling motion may be performed. After the rinsing cycle, the spin-drying cycle may be implemented again.

Hereinafter, a method for controlling the washing motor 93 and the circulation pump motor 92 in each drum driving motion will be described in more detail.

Figure 12:
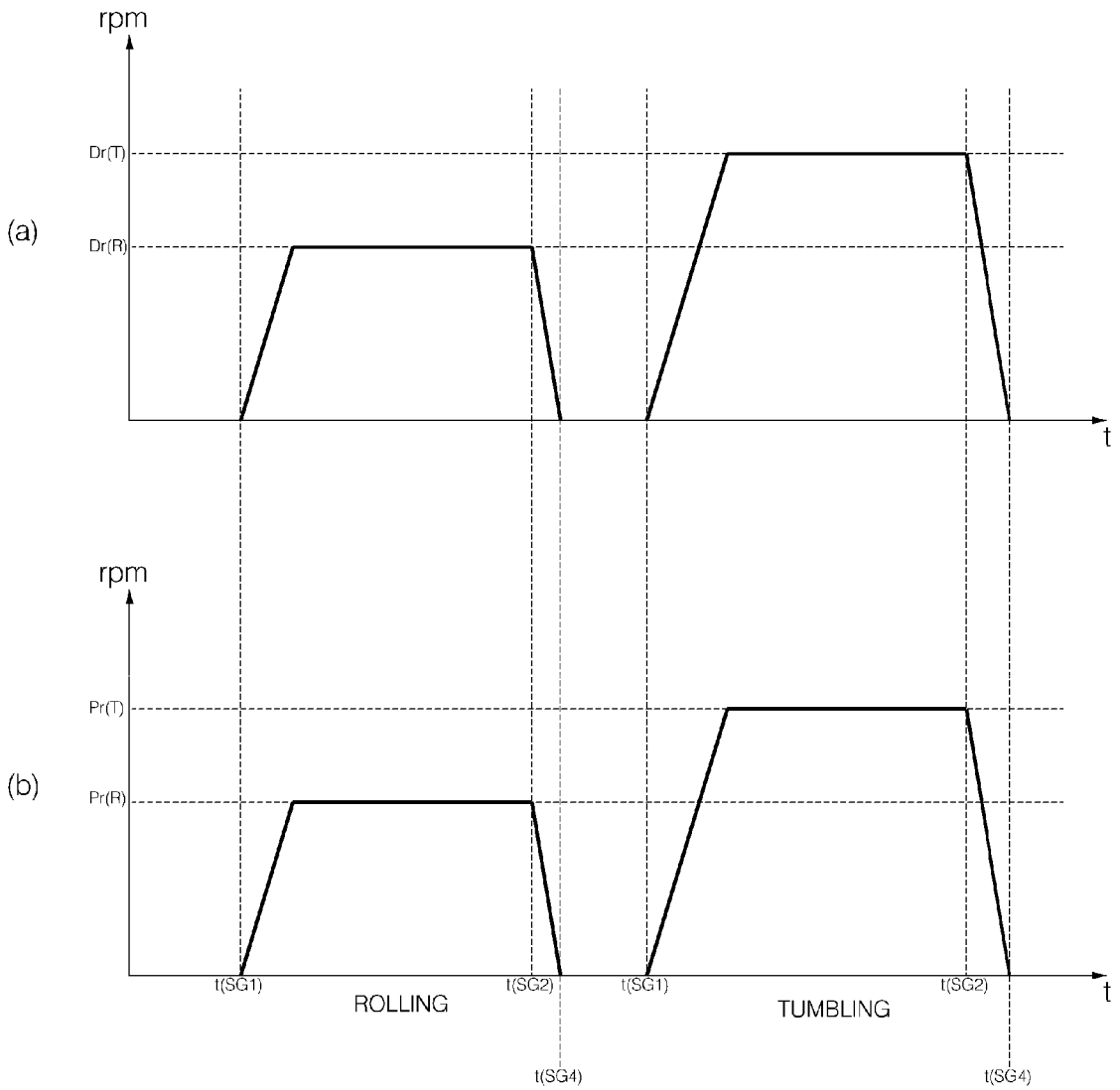
FIG. 12 are graphs illustrating a speed (a) of a washing motor and a speed (b) of a circulation pump motor in a rolling motion and a tumbling motion.
Figure 16:
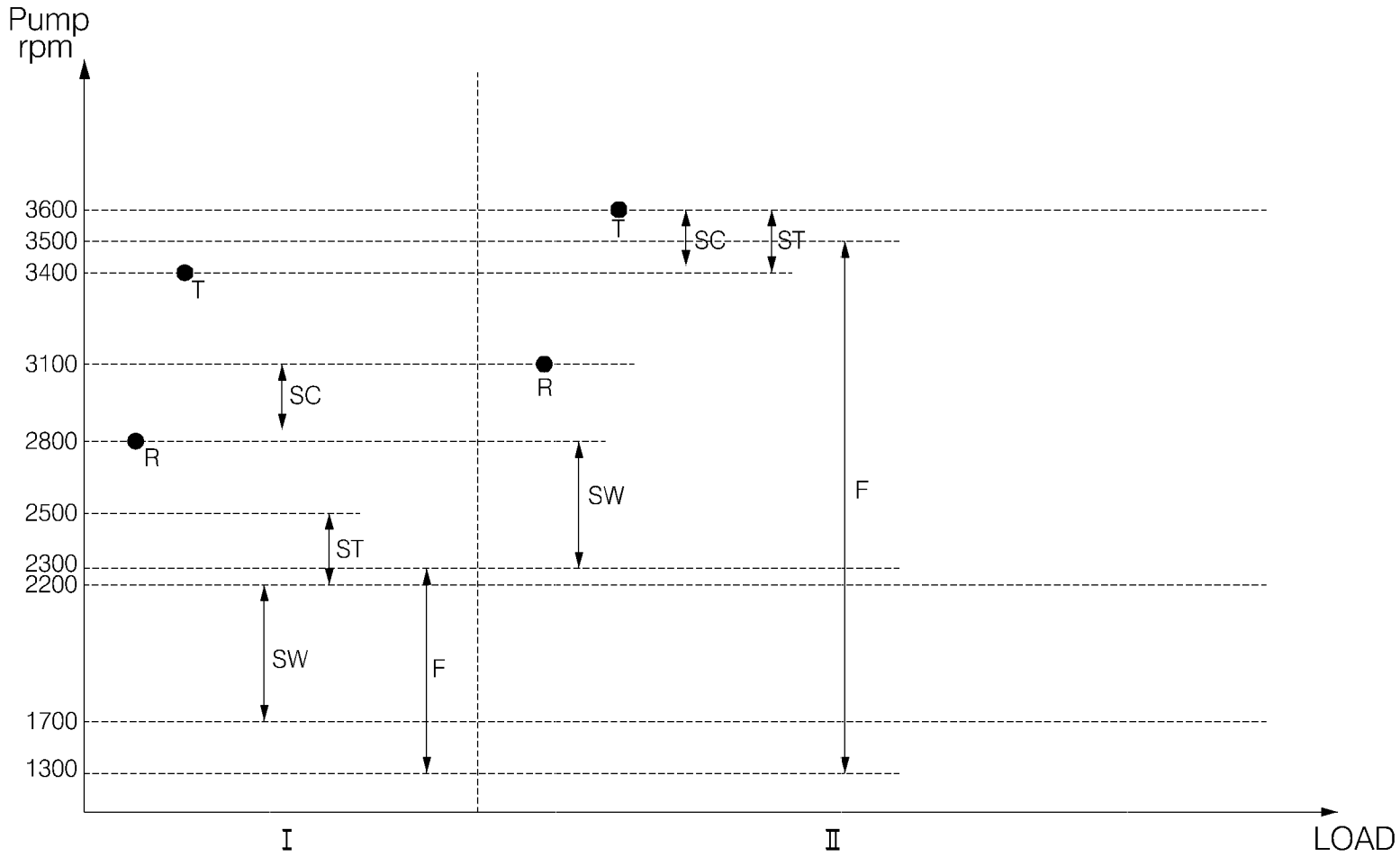
FIG. 16 is a graph for comparing a speed of a circulation pump motor in each drum driving motion between when a laundry load falls into a first laundry load range I and when the laundry load falls into a second laundry road range II.

FIG. 12 shows a graph of a speed (a) of a washing motor in the rolling motion and the tumbling motion, and a graph of a speed (b) of a circulation pump motor in the rolling motion and the tumbling motion. FIG. 16 is a graph of comparison between when a laundry load falls within a first laundry load range I and when a laundry load falls within a second laundry load range II.

The washing machine may perform a first step of rotating the drum 40 in one direction such that laundry on the inner circumferential surface of the drum 40 is lifted to a point corresponding to a rotation angle about less than 90 degrees of the drum 40 and falls therefrom, and a second step of rotating the drum 40 in one direction such that laundry on the inner circumferential surface of the drum 40 is lifted higher than a point corresponding to a rotation angle less than 130 degrees of the drum 40 and then falls therefrom. The second step may be performed after the first step, but aspects of the present invention are not limited thereto, and the second step may be performed prior to the first step.

The number of times of rotation of the circulation pump 36 during the first step may be controlled to a preset first rotation value, and the number of times of rotation of the circulation pump 36 during the second step may be controlled to a second rotation value higher than the first rotation value. Here, the first rotation value and the second rotation value are values in a period in which the circulation pump 36 rotates with maintaining a constant speed.

A driving motion of the drum 40 (that is, a drum driving motion) in the first step may correspond to the rolling motion. A drum driving motion in the second step may be the rolling motion or the tumbling motion, and may be preferably the tumbling motion. Hereinafter, an example of performing the rolling motion in the first step and the tumbling motion in the second step is described Referring to FIGS. 12 to 16, the rolling motion and the tumbling motion are performed with water contained in the tub 31 so that a water stream can be sprayed through at least one nozzle 83*a* or 83*b*. Referring to FIG. 12, in the rolling motion, the drum 40 is accelerated to a rotation speed Dr(R) and rotates with maintaining the rotation speed Dr(R) for a predetermined time. The rotation speed Dr(R) is preferably 37 to 40 rpm but not necessarily limited thereto.

During the rolling motion, a rotation speed of the circulation pump motor 92 is controlled to a preset rotation speed Pr(R). In FIG. 12, t(SG1) denotes a time when a star signal SG1 (see FIG. 10) is generated, t(SG2) denotes a time when an angle control completion signal SG2 (see FIG. 10) is generated, and t(SG4) is a time when a stop signal SG4 (see FIG. 10) is generated. Hereinafter, the same indications are used in other examples.

The rotation speed Pr(R) may be set according to a laundry load. Before implementing a drum driving motion, the processor 91 may rotate the washing motor 93 and sense a laundry load while rotating the washing motor 93. The laundry load may be determined based on the principle that rotation inertia of the drum 40 changes according to a load of laundry accommodated in the drum 40. For example, the laundry load may be calculated by measuring a time taken to reach a preset target speed, by measuring an acceleration gradient of the washing motor 93, by measuring a time taken to stop the washing motor 93 in the course of braking the washing motor 93, by measuring a deceleration gradient, or by measuring a counter-electromotive force. Aspects of the present invention are not limited thereto, and various methods of calculating a laundry load have been well-known in washing machine-related fields and thus these well-known methods may be applicable. Hereinafter, although not described, it is assumed that a step of sensing a laundry load is performed before performing each drum driving motion.

The processor 91 may set the rotation speed Pr(R) according to a laundry load range into which a sensed laundry load falls. For example, a laundry load may be divided into first to ninth categories. In the case where the laundry load range is divided into a light load (or the first laundry load range I; see, FIG. 16) and a heavy load (or the second laundry load range II; see, FIG. 16), if the sensed laundry load corresponds to the first to fourth categories, it may be classified into a light load, and, if the sensed laundry load corresponds to the fifth to ninth categories, it may be classified as a heavy load. However, aspects of the present invention are not limited thereto, and a laundry load range may be divided for each category.

In the embodiment, when a laundry load is heavy, the rotation is set higher than when the laundry load is light. For example, if the laundry load is light, the rotation speed Pr(R) may be set to 2800 rpm, and, if the laundry load is heavy, the rotation speed Pr(R) may be set to 3100 rpm. In particular, when the laundry load is light, most of the laundry is moving in the front portion of the drum 40 and thus a water stream sprayed from the at least one nozzle 83*a* or 83*b* does not necessarily reach the rear surface 41 of the drum 40. (less than 2800 rpm; See FIG. 6).

On the contrary, when the laundry load is heavy, laundry is loaded up to the center of the drum 40 and thus a water stream sprayed from the at least one nozzle 83*a* or 83*b* needs to reach a height higher than the center of the drum 40. Therefore, it is preferable that the water stream reaches the first quadrant Q1 (see FIG. 5) and the second quadrant Q2 (see FIG. 5), and, to this end, a rotation speed of the circulation pump motor 92 is set to 3000 rpm or higher, preferably 3100 rpm.

In the tumbling motion, the washing motor 93 and the circulation pump motor 92 are controlled in a manner similar to a manner in the rolling motion. However, with respect to the same laundry load, the rotation speed Dr(R) of the washing motor 93 in the tumbling motion is set higher than in the rolling motion, and the rotation speed Pr(T) of the circulation pump motor 92 in the tumbling motion is also set higher than in the rolling motion. Meanwhile, the rotation speed Dr(T) of the washing motor 93 is preferably 46 rpm but not necessarily limited thereto.

Meanwhile, in the tumbling motion, it is important to apply a stronger mechanical force to laundry than in the rolling motion, and thus, a water stream sprayed through the at least one nozzle 83*a* or 83*b* needs to have sufficient pressure regardless of a laundry load. Thus, in the tumbling motion, the circulation pump motor 92 may rotate at a constant speed of a predetermined value between 3400 rpm and 3600 rpm, regardless of a laundry load. However, aspects of the present invention are not limited thereto, and, when the laundry load is heavy, the rotation speed Pr(T) may be set higher than when the laundry load is light. For example, the rotation speed Pr(T) may be set to 3400 rpm when the laundry load is light, and 3600 rpm when the laundry load is heavy.

Steps of controlling the circulation pump 36 while implementing the above-described rolling and tumbling motions are appropriate for the washing cycle and/or the rinsing cycle among a series of cycles shown in FIG. 11.

Figure 13:
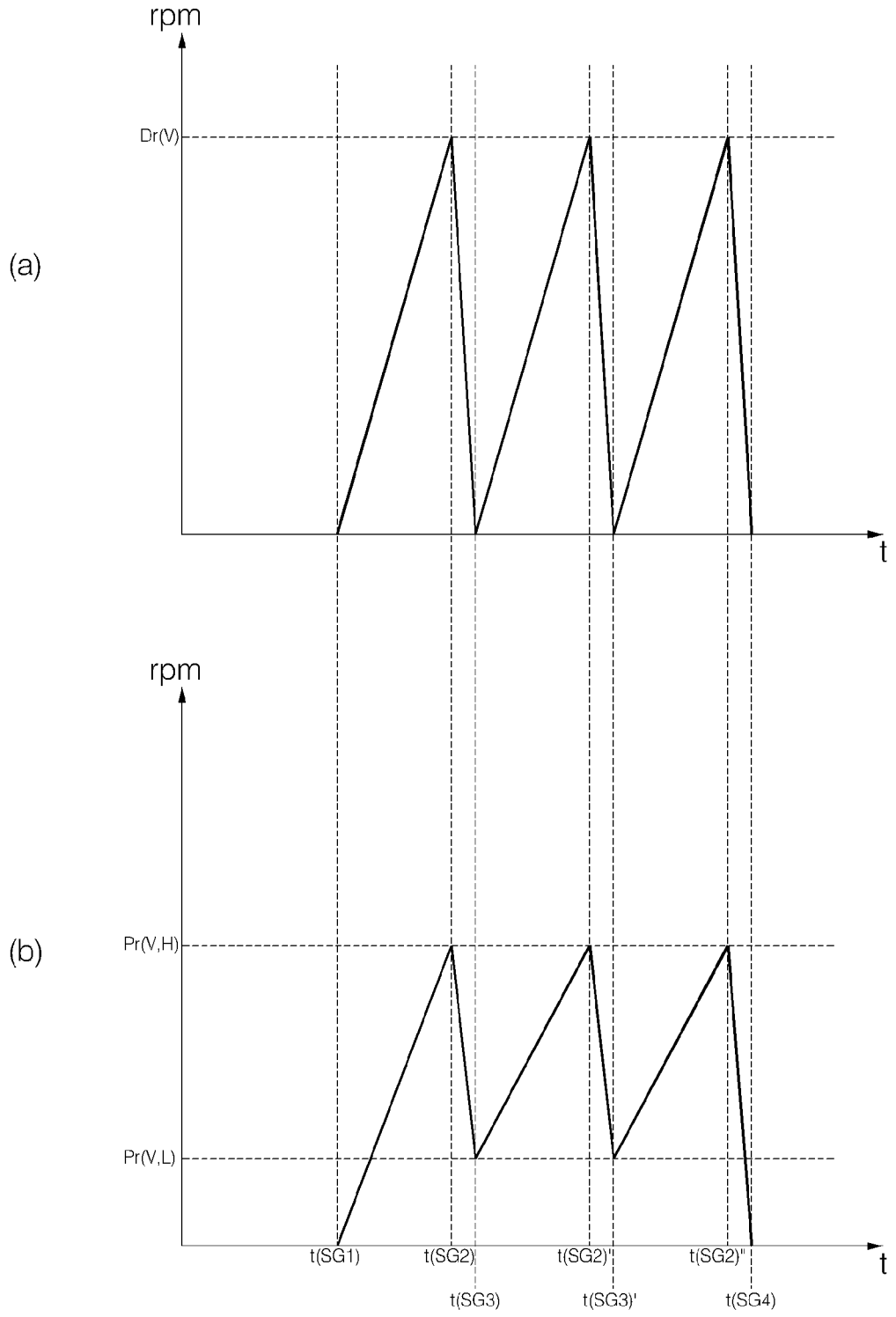
FIG. 13 is a graph for explanation of how a washing motor and a circulation pump motor operate in a swing motion, a scrub motion, and a step motion according to an embodiment of the present invention.

FIG. 13 is a graph for explanation of how a washing motor and a circulation pump motor operate in a swing motion, a scrub motion, and a step motion according to an embodiment of the present invention.

Referring to FIGS. 13 and 16, in a falling trigger motion by braking, the processor 91 performs control such that a rotation speed of the circulation pump motor 92 changes while the drum 40 rotates.

The falling trigger motion by braking is performed with the tub 31 having water contained therein such that a water stream is sprayed through the nozzle 83*a* or 83*b*. In the falling trigger motion by braking, the processor 91 may accelerate the washing motor 93 such that laundry on the inner circumferential surface 42 of the drum 40 is lifted while sticking to the drum 40. After accelerating the washing motor 93 such that the drum 40 rotates at a speed at which the laundry is lifted without falling from the inner circumferential surface of the drum 40, the processor 91 brakes the washing motor 93 such that the laundry falls from the inner circumferential surface 42. That is, in the falling trigger motion by braking, the washing motor 93 accelerated to a preset rotation speed Dr(V) is decelerated to stop.

The rotation speed Dr(V) may be set differently for each drum driving motion. The maximum laundry lifting height increases in order of the swing motion, the scrub motion, and the step motion, and thus, the magnitude of the centrifugal force should increase in order of the swing motion, the scrub motion, and the step motion. Therefore, the rotation speed Dr(V) may be set to increase in order of the swing motion, the scrub motion, and the step motion.

However, the maximum laundry lifting height in the falling trigger motion by braking is also determined by a rotation angle (or, a motion angle θ) by which the drum 40 is braked, and thus, even in the case where an identical rotation speed Dr(V) is set for all of the swing motion, the scrub motion, and the step motion, if a motion angle θ is set differently for each of the motions, the maximum laundry lifting height (or a height at which laundry starts falling) may differ. In either case, it is preferable that the motion angle θ is set to increase in order of the swing motion, the scrub motion, and the step motion. Within a range in which the above premise is satisfied, the motion angle θ may be set to be, for example, 30 to 45 degrees for the swing motion, 139 to 150 degrees for the scrub motion, and 146 to 161 degrees for the step motion.

Meanwhile, during the falling trigger motion by braking, the processor 91 may increase the rotation speed of the circulation motor 92 while laundry is lifted (or while the washing motor 93 is accelerated).

During the falling trigger motion by braking, the processor 91 may decelerate the rotation speed of the circulating pump motor 92 while laundry falls (or when the washing motor 93 is braked, thereby being decelerated).

That is, the processor 91 may control the circulation pump motor 92 such that the circulation pump motor 92 is accelerated in response to acceleration of the washing motor 93 and decelerated in response to braking of the washing motor 93.

The rotation speed of the circulation pump motor 92 may be varied within a rotation speed range set for each drum driving motion. In FIG. 13, the upper limit value of the rotation speed range is indicated as the highest rotation speed Pr(V, H), and the lower limit value thereof is indicated as the lowest rotation speed Pr (V, L).

Hereinafter, the highest rotation speed of the circulation pump motor 92 as the upper limit of a preset rotation speed range. The highest rotation speed of the circulation pump motor 92 does not refer to the maximum speed at which the circulation pump 92 is capable of rotating.

Before implementing a drum driving motion, the processor 91 may rotate the washing motor 93 and sense a laundry load while rotating the washing motor 93. A method for sensing the laundry load may be implemented as described above in regard with the rolling/tumbling motion, or any other method may be used.

The rotation speed range may be set according to a laundry load. That is, the processor 91 may set the highest rotation speed Pr(V, H) and the lowest rotation speed Pr(V, L) according to the laundry load. In each drum driving motion, the rotation speed range may be set to be higher as the laundry load is heavier.

For example, in the case of a scrub motion SC, when a sensed laundry load corresponds to a light load (or the first laundry load range I; see FIG. 16), the rotation speed of the circulation pump motor 92 may be varied between the lowest rotation speed Pr (V, L) of 2800 rpm and the highest rotation speed Pr(V, H) of 3100 rpm. In addition, when a sensed laundry load corresponds to a heavy load (or the second laundry load range II; see FIG. 16), the rotation speed of the circulation pump motor 92 may be varied between the lowest rotation speed Pr(V, L) of 3400 rpm and the highest rotation speed Pr(V, H) of 3600 rpm.

In the case of a step motion ST, when a sensed laundry load corresponds to a light load (or the first laundry load range I; see FIG. 16), the rotation speed of the circulation pump motor 92 may be varied between the lowest rotation speed Pr (V, L) of 2200 rpm and the highest rotation speed Pr(V, H) of 2500 rpm. In addition, when a sensed laundry load is corresponds to a heavy load (or the second laundry load range II; see FIG. 16), the rotation speed of the circulation pump motor 92 may be varied between the lowest rotation speed Pr(V, L) of 3400 rpm and the highest rotation speed Pr(V, H) of 3600 rpm.

Meanwhile, even in the case of a swing motion SW, a range in which the rotation speed of the circulation pump motor 92 is varied according to a laundry load may be set in a manner similar to that of the scrub motion SC or the step motion ST.

In this case, it is preferable that the rotation speed of the circulation pump motor 92 is set within a range which does not allow a water stream sprayed from the at least one nozzle 83*a* or 83*b* to reach the rear surface 41 of the drum 40 (for example, 2200 to 2800 rpm; see FIG. 6).

However, since the height at which laundry falls in the swing motion is smaller than in the scrub motion or the step motion, a predetermined rotation speed range of the circulation pump motor 92 may be set regardless of a laundry load. For example, both in the case of a heavy laundry load and in the case of a light laundry load, the rotation speed of the circulation pump motor 92 may be varied between the lowest rotation speed Pr(V, L) of 2200 rpm and the highest rotation speed Pr(V, H) of 2800 rpm.

Hereinafter, operations of a washing motor and a circulation pump motor in a swing motion, a scrub motion, and a step motion according to an embodiment of the present invention will be described in more detail with reference to FIGS. 10, 13, and 16.

Figure 10:
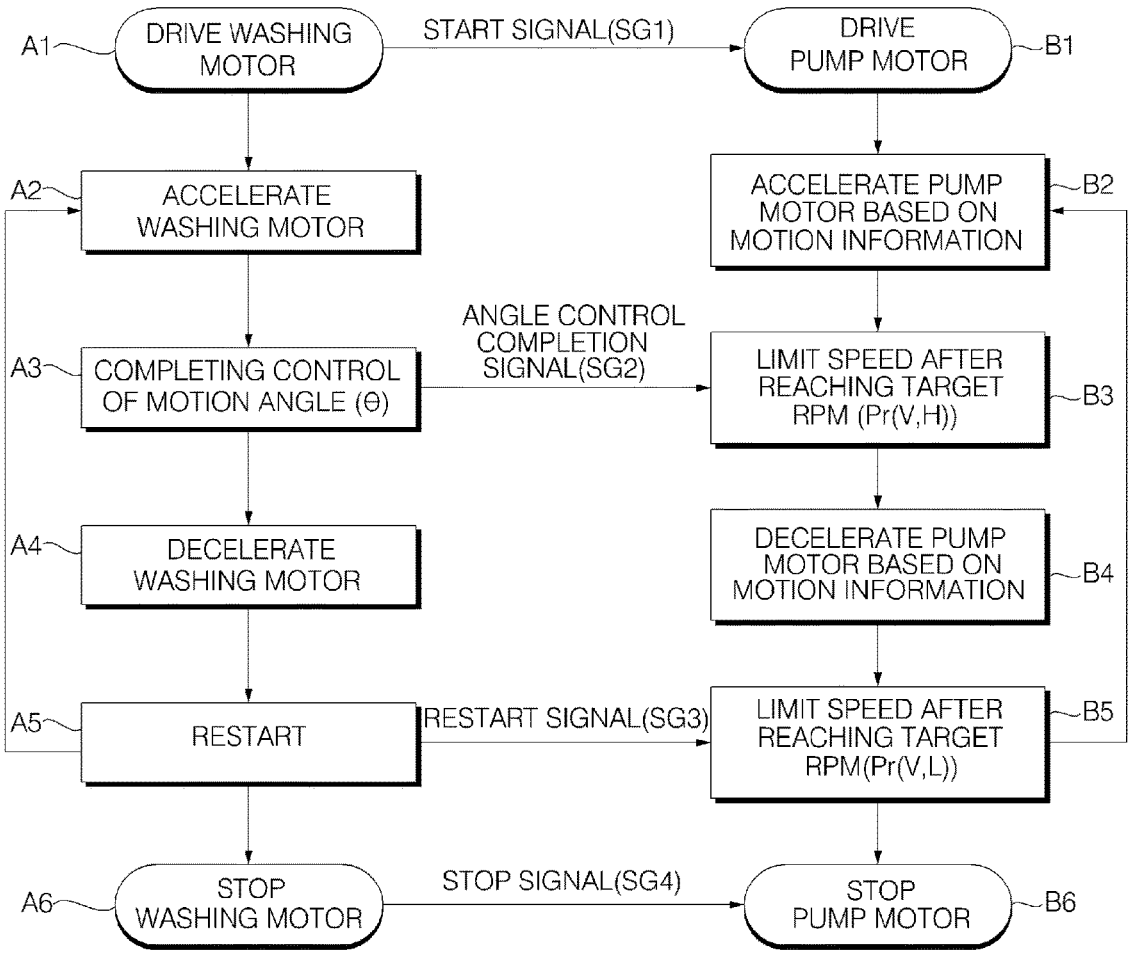
FIG. 10 is a flowchart illustrating a method for controlling a washing motor and a circulation pump motor in drum driving motions.

Referring to FIGS. 10 and 13, the processor 91 may accelerate the washing motor 93 to a preset highest rotation speed Dr(V) (A2).

When the washing motor 93 is driven (A1), the processor 91 may generate a start signal SG1. In response to the start signal SG1, the circulation pump motor 92 may start operating.

When the circulation pump motor 92 is driven (B1), the processor 91 may accelerate the circulation pump motor 92 based on motion information (B2).

The processor 91 may accelerate the circulation pump motor 92 up to the highest rotation speed Pr(V, H). When the circulation pump motor 92 reaches the target RPM (Pr(V, H)), the processor 91 may stop accelerating the circulation pump motor 92, limiting the speed thereof (B3).

The processor 91 may rotate the washing motor 93 up to by a preset motion angle θ. The processor 91 may control the washing motor 93 such that a time when the washing motor 93 reaches the highest rotation speed Dr(V) and a time when the washing motor 93 is rotated by the motion angle θ corresponds to each other.

When the washing motor 93 rotates up to the motion angle θ (A3), the processor 91 may generate an angle control completion signal SG2. In accordance with the angle control completion signal SG2, the circulation pump motor 92 may be decelerated (B4).

Referring to FIG. 13, the processor 91 may control the washing motor 91 and the circulation pump motor 92 such that a time when the washing motor 93 reaches the highest rotation speed Dr(V) and a time when the circulation pump motor 92 reaches the highest rotation speed Pr(V, H) correspond to each other.

However, time delay, such as a time required to perform processing by the processor 91 or a time required to transmit a signal, may occur between a time t(SG2) when the angle control completion signal SG2 is generated as the washing motor 93 is controlled to the motion angle θ (or s the washing motor 93 reaches the highest rotation speed Dr(V)) (A3), and a time when deceleration of the circulation pump motor 92 starts in response to the generated angle control completion signal SG2. Therefore, as illustrated in FIG. 13, in order to decelerate the circulation pump motor 92 immediately at the time when the washing motor 93 reaches the highest rotation speed Dr(V), it is preferable that the processor 91 anticipates an angle control completion time (that is, a time when washing motor 93 reaches the highest rotation speed Dr(V)) and generates the angle control completion signal SG2 a little bit earlier than the angle control completion time.

Figure 14:
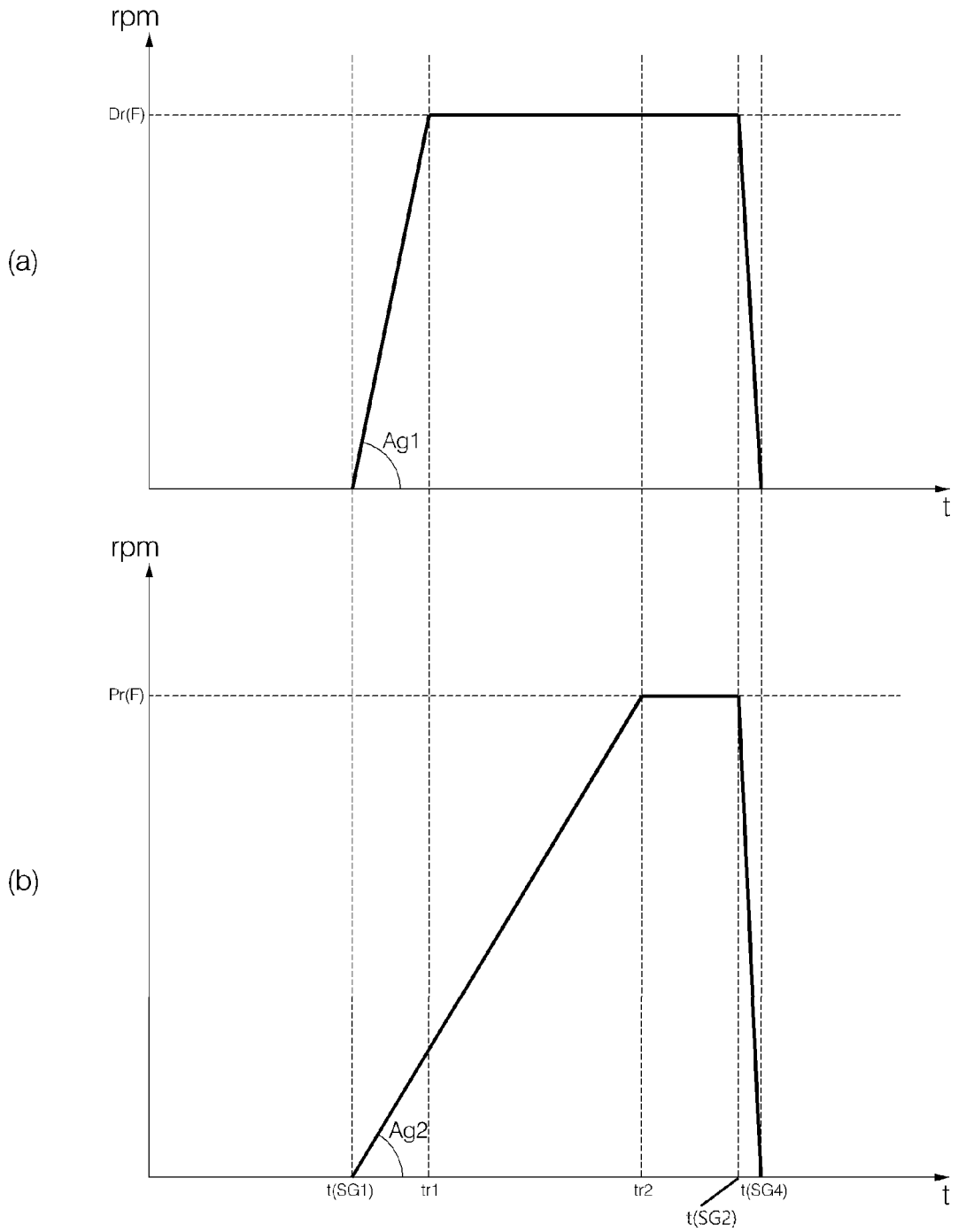
FIG. 14 illustrates a change in the number of times of rotation (a) of a drum (a) and a change in the number of times of rotations of a pump (b) according to an embodiment of the present invention.
Figure 15:
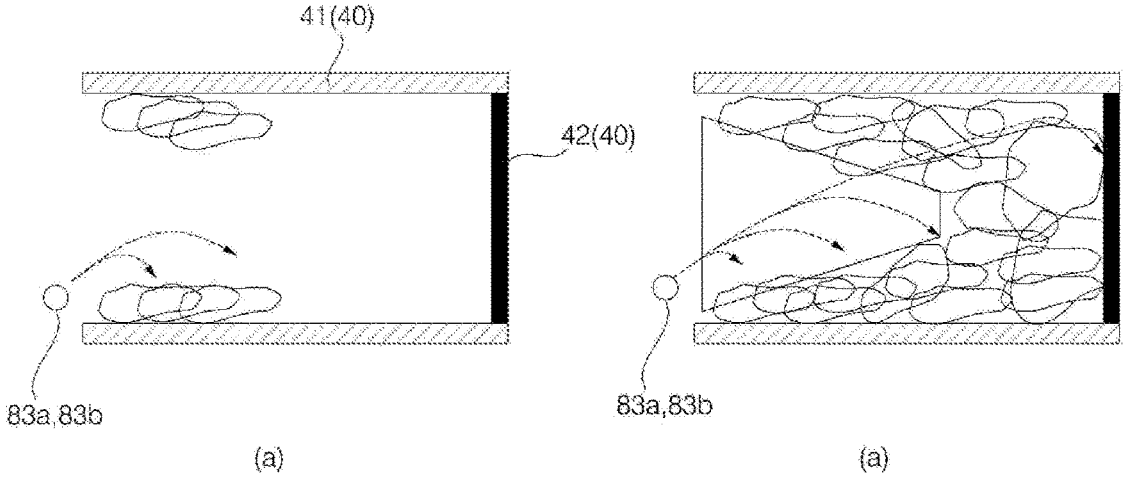
FIG. 15 illustrates the form of arrangement of laundry in a drum in the middle of a filtration motion.

FIG. 14 illustrates a change in the number of times of rotation (a) of a drum (a) and a change in the number of times of rotations of a pump (b) according to an embodiment of the present invention. FIG. 15 illustrates the form of arrangement of laundry in a drum in the middle of a filtration motion. In FIG. 15, (a) illustrates the case where a small amount of laundry is loaded in the drum, and (b) illustrates the case where a large amount of laundry is loaded in the drum.

A method for controlling a washing machine according to an embodiment of the present invention includes a step of rotating the drum 40 in one direction such that laundry to prevent the drum 40 from falling from the inner circumferential surface of the drum 40. This step corresponds to the above-described filtration motion.

Referring to FIGS. 14, 15, and 16, the processor 91 may perform control such that a rotation speed Pr(F) of the circulation pump motor 92 increases while the drum 40 rotates in one direction (preferably, one or more times) during the filtration motion. If a rotation speed of the drum 40 starts to increase during the filtration motion, the centrifugal force applied to laundry increases as well and a laundry item in the most vicinity to the inner circumferential surface of the drum 40 becomes sticking thereto sequentially. That is, in the course in which the rotation speed of the drum 40 increases to the preset rotation speed Dr(F) in the filtration motion, a sufficient centrifugal force is not provided in the initial stage to laundry positioned at the center of the drum 40, thereby causing the laundry to move. Afterward, if the rotation speed of the drum 40 increases sufficiently, the position of most of the laundry (preferably, all of the laundry) in the drum 40 is fixed relative to the drum 40.

In particular, if the amount of laundry in the drum 40 is equal to or smaller than a predetermined threshold, the laundry is usually gathered around the entrance of the drum 40 in the filtration motion (see (a) of FIG. 15). In this case, it is preferable to decrease the rotation speed of the circulation pump 36 such that circulating water sprayed from the at least one nozzle 83*a* or 83*b* falls in the front portion of the drum 40.

On the contrary, if the amount of laundry in the drum 40 is greater than the predetermined threshold, an empty space in the drum 40 surrounded by the laundry extends toward the rear from the entrance of the drum 40 while the rotation speed of the drum 40 increases, thereby resulting in the form shown in (b) of FIG. 15.

Controlling the rotation speed of the circulation pump 36 to increase in the filtration motion is conceived from the above-described extension of the empty space in the drum 40, which occurs in the filtration motion. That is, while the empty space extends toward the rear of the drum 40, jetting pressure of the at least one nozzle 83*a* or 83*b* is controlled to increase in accordance therewith, thereby allowing water stream to reach a region deep inside the drum 40.

In the filtration motion, the processor 91 accelerates the washing motor 93 to the preset rotation speed Dr(F), and, when the washing motor 93 reaches the preset rotation speed Dr(F), the processor 91 performs control to maintain the preset rotation speed Dr(F) for a preset time period. The rotation speed Dr(F) is determined within a range of speeds at which laundry rotates while stuck to the inner circumferential surface of the drum 40, and the rotation speed Dr(F) may vary according to a laundry load and may be set to between 80 rpm and 108 rpm, approximately.

The processor may accelerate the washing motor 93 at a set first acceleration gradient Ag1 to the rotation speed Dr(F). Based on a time period tr1 until reaching to the highest rotation speed Dr(F), the processor 91 may set the first acceleration gradient Ag1. The time period tr1 may be set differently according to a laundry load.

Alternatively, the processor 91 may perform control such that the rotation speed Dr(F) is maintained until the washing motor 93 rotates a set angle. In this case, the set angle may differ according to a laundry load.

In the filtration motion, the highest rotation speed Pr(F) of the circulation pump motor 92 may be set differently according to a laundry load. That is, the processor 91 may set the highest rotation speed Pr(F) of the circulation pump motor 92 according to a sensed laundry load. The highest rotation speed Pr(F) of the circulation pump motor 92 may be set such that the highest rotation speed Pr(Fs) in response to the sensed laundry load corresponding to a light load (or the first laundry load range I; see FIG. 16) is higher than the highest rotation speed Pr(Fm) in response to the sensed laundry road corresponding to a heavy load (or the second laundry load range II; see FIG. 16).

In this case, the rotation speed of the circulation pump 36 may be set to increase in correspondence with a time t1 when the rotation of the drum 40 is accelerated. That is, the time of when to accelerate the rotation of the drum 40 and the time of when to increase the rotation speed of the circulation pump 36 are linked (or synchronized).

In the filtration motion, the processor 91 may perform control such that the circulation pump motor 92 is accelerated to a set rotation speed Pr(F) and, when reaching to the rotation speed Pr(F), maintains the rotation speed Pr(F).

The processor 91 may accelerate the circulation pump motor 92 at a set second acceleration gradient Ag2 to the rotation speed Pr(F). The second acceleration gradient Ag2 may be set to be equal to or smaller than the first acceleration gradient Ag1.

Alternatively, the processor 91 may set the second acceleration gradient Ag2 based on a time period tr2 taken to reach the highest rotation speed Pr(F). The time period Tr2 may differ according to a laundry load.

When the washing motor 93 stops, the processor 91 may generate a stop signal SG4. In response to the stop signal SG4, the circulation pump motor 92 may stop (A6).

The method for controlling a washing machine according to the embodiments of the present invention may further include a step of sensing an amount of laundry in the drum 40 (hereinafter, referred to as a "laundry load"). There are various well-known methods for calculating a laundry load. For example, the drum 40 may be accelerated with laundry loaded therein, and a laundry load may be determined based on a time period taken until a rotation speed of the drum 40 reaches a preset rotation speed. However, aspects of the present invention are not limited thereto, and the laundry load may be calculated using any other well-known method.

Controlling the circulation pump 36 while implementing the filtration motion, as described above, is appropriate for the water supplying/laundry soaking cycle or the rinsing cycle among the series of cycles shown in FIG. 11.

Figure 17:
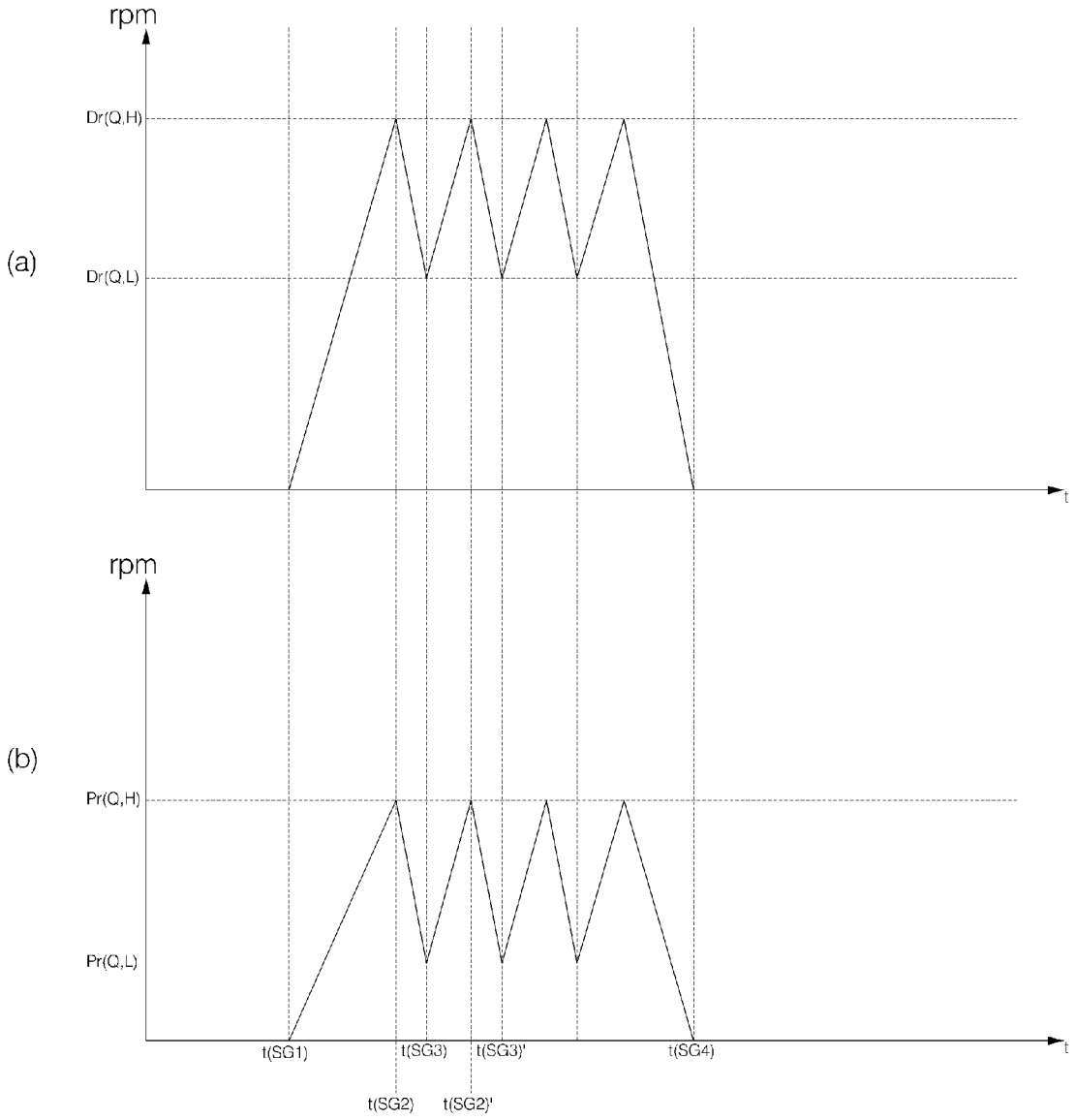
FIG. 17 illustrates a change in the number of times of a drum (a) and a change in the number of times of a pump (b) according to an embodiment of the present invention.
Figure 18:
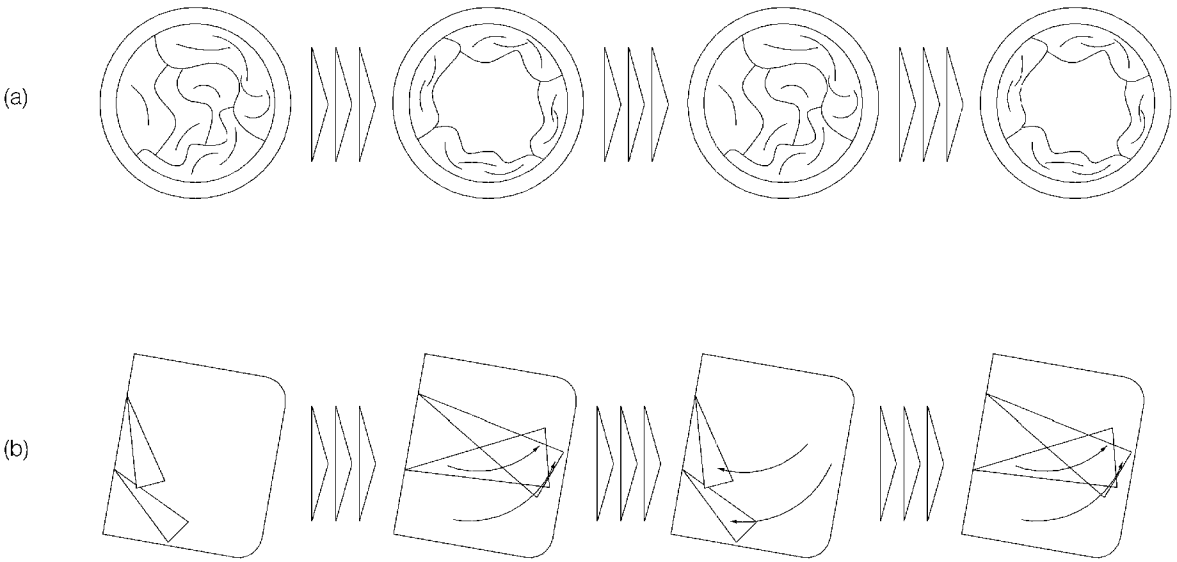
FIG. 18 is a diagram for explanation of a squeeze motion according to an embodiment of the present invention.
Figure 19:
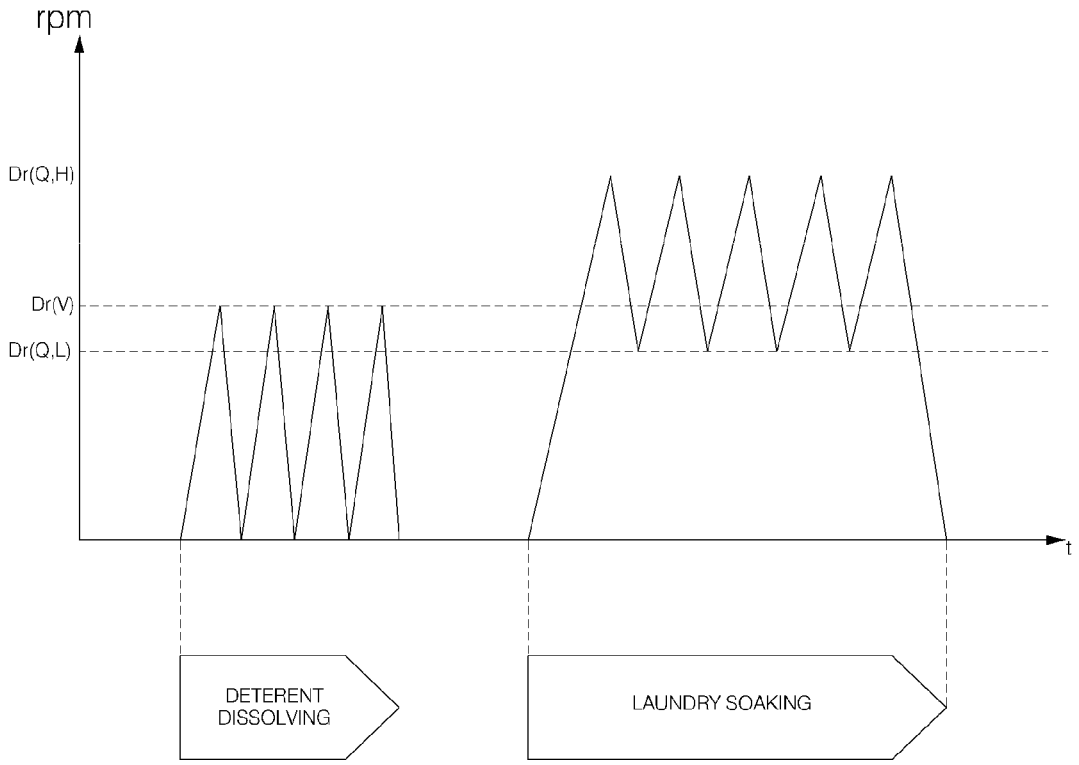
FIG. 19 is a diagram for explanation of a water supplying/laundry soaking cycle according to an embodiment of the present invention.

FIG. 17 is a diagram illustrating a change in the number of times of a drum (a) and a change in the number of times of a pump (b) according to an embodiment of the present invention. FIG. 18 is a diagram for explanation of a squeeze motion according to an embodiment of the present invention. FIG. 19 is a diagram for explanation of a water supplying/laundry soaking cycle according to an embodiment of the present invention. Hereinafter, description is provided with reference to FIGS. 17 to 19.

In a method for controlling a washing machine according to an embodiment of the present invention, in the course of performing a squeeze motion, the circulation pump 36 is accelerated in response to acceleration of the washing motor 93 and decelerated in response to deceleration of the washing motor 93.

Specifically, in the method, acceleration and deceleration of the washing motor 93 are repeated alternatively, such the washing motor 93 is accelerated to make laundry in the drum 40 to rotate along with the drum 40 while stuck to the drum 40 owing to the centrifugal force and the washing motor 93 is decelerated to make the laundry 40 to be separated from the drum 40. In this course, the circulation pump motor 92 is operated to spray water through the at least one nozzle 83*a* or 93*b*. At this point, the circulation pump motor 93 is accelerated in response to acceleration of the washing motor 93 and decelerated in response to deceleration of the washing motor 93.

The processor 91 may accelerate the washing motor 93 up to a first rotation speed (or the highest rotation speed Dr(Q, H) such that the laundry in the drum 40 rotates along with the drum 40 to form an empty space surrounded by the laundry owing to the centrifugal force.

The highest rotation speed DR (Q, H) of the washing motor 93 in the squeeze motion may be equal to or greater than 70 rpm (preferably, 80 rpm). The lowest rotation speed DR(Q, L) of the washing motor 93 may be defined as the lower limit of a set rotation speed range. The lowest rotation speed DR(Q, L) may be set to be equal to or greater than 35 rpm and smaller than 55 rpm (preferably 46 rpm).

Referring to (a) of FIG. 18, once the drum 40 starts to rotate, laundry starts to rotate along with the drum 40 (see the fat left drawing in (a) of FIG. 18).

Referring to (b) of FIG. 18, while the washing motor 93 is accelerated, the processor 91 may accelerate the circulation pump motor 92 within a preset rotation speed range such that water is sprayed through at least one nozzle 83*a* or 83*b*. At a time t=t(SG1) when acceleration of the washing motor 93 starts, the processor 91 may start to accelerate the circulation pump motor 92.

If the circulation pump motor 92 is accelerated to rotate at a predetermined speed or higher, water may be sprayed from the at least one nozzle 83*a* or 83*b*. In this case, the water sprayed from the at least one nozzle 83*a* or 83*b* may be directed toward an area which is close to the front surface of the drum 40 on the inner circumferential surface of the drum 40 (see, the far left drawing in (b) of FIG. 18).

If the drum 40 rotates at the predetermined speed or higher, the laundry in the drum 40 becomes stick to the inner circumferential surface 42 of the drum 40 owing to the centrifugal force. In this case, a cylindrical space surrounded by the laundry (or an empty space at the center of the drum 40) is formed (see, the second drawing from the left in (a) of FIG. 18).

The cylindrical space surrounded by the laundry may extend as the laundry is more tightly stuck to the inner circumferential surface of the drum 40. That is, if the centrifugal force acting on the laundry increases as the rotation speed of the drum 40 increases, the cylindrical space surrounded by the laundry may extend.

The processor 91 may accelerate the circulation pump motor 92 in response to acceleration of the washing motor 93. The processor 91 may accelerate the circulation pump motor 92 up to the highest rotation speed Pr(Q, H). In the squeeze motion, the highest rotation speed Pr(Q, H) of the circulation pump motor 92 may be a rotation speed (2200 to 3600 rpm, and preferably 3500 rpm) at which water stream sprayed from the at least one nozzle 83*a* or 83*b* reaches the rear surface of the drum 40.

As the circulation pump motor 92 is accelerated, water sprayed from the at least one nozzle 83*a* or 83*b* may move to be directed further toward the rear surface of the drum 40. If the circulation pump motor 92 is accelerated to be a predetermined speed or more, water sprayed from the at least one nozzle 83*a* or 83*b* may be directed toward the rear surface 41 of the drum 40 (see the second drawing from the left in (b) of FIG. 18).

If the rotation speed of the washing motor 93 reaches the highest rotation speed Dr(Q, H), the processor 91 may decelerate the washing motor 93. As the rotation speed of the drum 40 decreases, the empty space formed in the drum 40 (that is, the empty space surrounded by the laundry) is reduced (see, the third drawing from the left in (a) of FIG. 18). The washing motor 93 may be decelerated until reaching a second rotation speed (or the lowest rotation speed Dr(Q, L).

In response to the deceleration of the washing motor 93, the processor 91 may decelerate the circulation pump motor 92 within a rotation speed range. While the washing motor 93 is decelerated, the processor 91 may decelerate the washing pump motor 92 up to the lowest rotation speed Pr(Q, L). At a time when the deceleration of the washing motor 93 starts, the processor 91 may decelerate the circulation pump motor 92.

When the circulation pump motor 92 rotates at the lowest rotation speed Pr(Q, L), water stream sprayed from the at least one nozzle 83*a* or 83*b* may reach a point closer to the front surface of the drum 40 than the rear surface 41 of the drum 40. The lowest rotation speed Pr(Q, L) may be 1100 to 1600 rpm, preferably 1300 rpm.

As the circulation pump motor 92 is decelerated, water sprayed from the at least one nozzle 83*a* or 83*b* may gradually moves to be directed toward the front surface of the drum 40. If the circulation pump motor 92 is decelerated to a predetermined speed or less, water sprayed from the nozzle 83*a* or 83*b* may be directed toward a point on the inner circumferential surface of the drum 40, the point which is closer to the front surface of the drum 40 than the rear surface 41 of the drum 40.

If the washing motor 93 is decelerated to the lowest rotation speed Dr(Q, L), the processor 91 may accelerate the washing motor 93. As the rotation speed of the drum 40 increases, the empty space formed in the drum 40 (that is, the empty space surrounded by the laundry) extends (see, the fourth drawing from the left in (a) of FIG. 18). The washing motor 93 may be accelerated until reaching to the highest rotation speed Dr(Q, H).

In response to acceleration of the washing motor 93, the processor 91 may accelerate the circulation pump motor 92 again to the highest rotation speed Pr(Q, H).

In response to the deceleration of the washing motor 93, the processor 91 may decelerate the circulation pump motor 92 within a rotation speed range. While the washing motor 93 is decelerated, the processor 91 may decelerate the circulation pump motor 92 to the lowest rotation speed Pr (Q, L). At a time when the deceleration of the washing motor 93 starts, the processor 91 may start to decelerate the circulation pump motor 92.

The above-described acceleration and deceleration of the washing motor may be repeated a preset number of times, and the acceleration and deceleration of the circulation pump motor 92 may be also repeated in response to the acceleration and deceleration of the washing motor. The above-described combination of the squeeze motion and an operation of the circulation pump 36 may be implemented during the water supplying/laundry soaking cycle. Hereinafter, more detailed description will be provided with reference to FIG. 19. The water supplying/laundry soaking cycle may include a detergent dissolving step and a laundry soaking step. The detergent dissolving step is performed with detergent and water being contained in the tub 31. In the laundry soaking step, the processor 91 may accelerate the washing motor 93 such that laundry on the inner circumferential surface of the drum 40 is lifted without falling from the inner circumferential surface 42 of the drum 40 owing to the centrifugal force, and then brake the washing motor 93 such that the laundry falls from the inner circumferential surface 42 of the drum 40. At this point, the drum driving motion may be a swing, scrub, or step motion.

According to an embodiment, in the detergent dissolving step, the processor 91 may brake the washing motor 93 when laundry is lifted from a lowest point in the drum to a height corresponding to a set angle which is set to be less than a rotation angle of 220 degrees of the drum 40.

According to an embodiment, the processor 91 may accelerate the washing motor 93 to the highest rotation speed Dr(V), and then brake the washing motor 93. The processor 91 may repeat an operation of accelerating the washing motor 93 to the highest rotation speed DR(V) and then braking the washing motor 93. The processor 91 may repeat the operation of accelerating the washing motor 93 to the highest rotation speed Dr(V) and then braking the washing motor 93, with changing a rotation direction of the drum 40 alternatively.

In the detergent dissolving step, the processor 91 may control the circulation pump motor 92 such that water is sprayed through the at least one nozzle 83*a* or 83*b*. In this case, the processor 91 may accelerate the circulation pump motor 92 in response to acceleration of the washing motor 93, and decelerate the circulation pump motor 92 in response to braking (or deceleration) of the washing motor 93.

The detergent dissolving step may be performed with detergent-dissolved water is filled to a first water level in the tub 31. Before the detergent dissolving step, the water supply valve 94 may be opened by the processor 91 such that water supplied through the water supply hose is supplied to the tub 31 together with detergent contained in the dispenser 35, and then the detergent dissolving step may be performed. Meanwhile, the first water level may be about a water level at which wash water is allowed to reach an inner side of the drum 40.

The laundry soaking step may be performed when the water level in the tub 31 reaches a second water level higher than the first water level. After the detergent dissolving step, the processor 91 may open the water supply valve 94 again, thereby supplying water to the inside of the tub 31. Detergent in the dispenser is already all used in the water supply to the first water level, and thus, in the water supply to the second water level, only water may be supplied to the inside of the tub 31 without addition of detergent although water guided through the water supply hose passes through the dispenser. However, aspects of the present invention are not limited thereto, and there may be further provided an additional flow path for guiding water, supplied through the water supply valve 94, without passing through the dispenser 35, and, in this case, water supply to the second water level may be performed through the additional flow path.

Detergent may be effectively dissolved in the detergent dissolving step, and laundry may be effectively soaked in the detergent-dissolved wash water within a short period of time in the laundry soaking step.

In the laundry soaking step, the squeeze motion and an operation of controlling the circulation pump 36 accordingly, which are described above with reference to FIGS. 17 and 18, may be performed.

Meanwhile, in the laundry soaking step, the processor 91 may set the highest rotation speed and/or the lowest rotation speed of the washing motor 93 according to a load of laundry in the drum 40. For example, if the highest rotation speed of the washing motor 93 in response to a small load of laundry in the drum 40 is Dr(Q, H1) and the highest rotation speed of the washing motor 93 in response to a large load of laundry in the drum 40 is Dr(Q, H2), the processor 91 may set Dr(Q, H2) to be higher than Dr(Q, H1). In doing so, when there is a large load of laundry, even the central portion of the drum 40 is filled with laundry, and, in order for the drum 40 to rotate with all laundry being stuck to the inner circumferential surface of the drum 40, a greater centrifugal force is required compared to the case where there is a small load of laundry. Thus, when there is a large load of laundry, the highest rotation speed is set higher than when there is a small load of laundry, thereby making the laundry to be stuck to the inner circumferential surface 42 of the drum 40.

The processor 91 may set a rotation speed range of the circulation pump motor 92 according to a sensed load of laundry. For example, in the case where the highest rotation speed of the circulation pump motor 92 in response to a small load of laundry in the drum 40 is Pr(Q, H1) and the highest rotation speed of the circulation pump motor 92 in response to a large load of laundry in the drum 40 is Pr(Q, H2), the processor 91 may set Pr(Q, H2) to be higher than Pr(Q, H1).

As described above with reference to FIG. 15, laundry is gathered from the front end to the rear end of the drum 40. If the highest rotation speed of the circulation pump motor 92 is increased according to a load of the laundry, a water stream may be allowed to reach the laundry close to the rear surface of the drum 40, thereby enhancing laundry soaking performance. In doing so, the laundry may be stuck to the inner circumferential surface 42 of the drum 40 further more.

The method for controlling a washing machine using the above-described squeeze motion enables effectively soaking laundry in detergent-dissolved water in the initial washing stage, thereby reducing a time for soaking the laundry and accordingly reducing the entire washing time.

In addition, circulating water is effectively sprayed in response to movement of laundry in a squeeze motion by varying a rotation speed of the circulation pump motor 92, thereby soaking laundry effectively.

Figure 20:
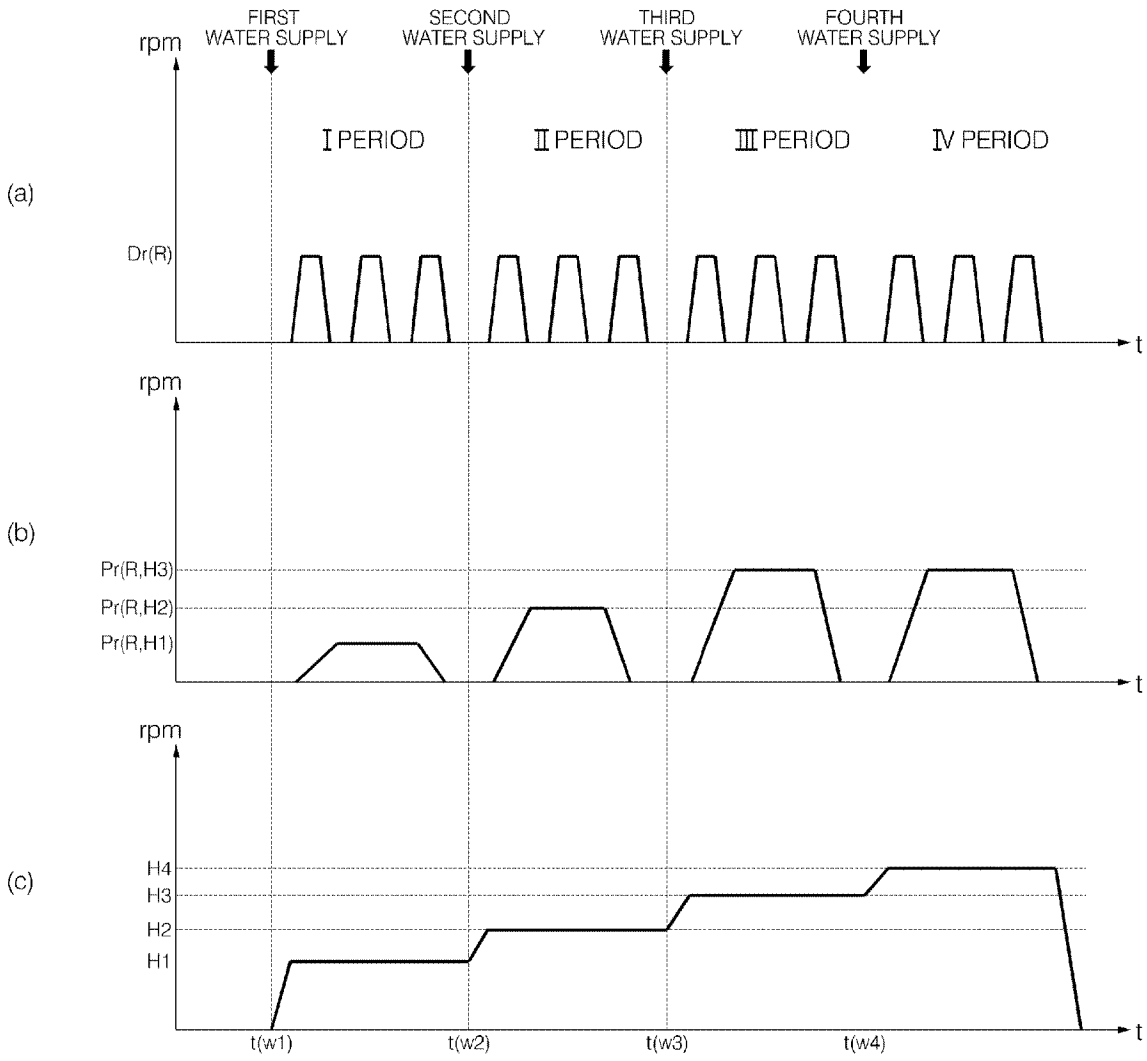
FIG. 20 is a diagram for explanation of a method for controlling a washing machine according to an embodiment of the present invention.

FIG. 20 is a diagram for explanation of a method of controlling a washing machine according to another embodiment of the present invention. Hereinafter, description will be provided with reference to FIG. 20. A method for controlling a washing machine according to another embodiment of the present invention may include a water supplying step of supplying water with detergent into the inside of the tub 31 to a first water level. The processor 91 may control the water supply valve 94 for a water supply to a dispenser 35.

After the water supplying step, a detergent dissolving step (which is the "dissolving detergent" step in FIG. 20) of operating the circulation pump 36 at a first speed and repeating acceleration and deceleration of the washing motor 93 is performed. The first speed may be set within a range in which water discharged from the circulation pump 36 is not allowed to reach the at least one nozzle 83*a* or 83*b*, or, even if the water is sprayed through the at least one nozzle 83*a* or 83*b*, the sprayed water is not allowed to reach the inner side of the drum 40. The first speed may be set to be equal to or lower than 1500 rpm.

In the above, the "at least one nozzle" is exemplified by two nozzles 83*a* and 83*b*, but it is merely an example and the at least one nozzle may be implemented variously. For example, the at least one nozzle may include two or more lower nozzles which spray water toward a first area on the inner circumferential surface of the drum 40, and two or more middle nozzles which are supplied with water through a flow path shared with the two or more lower nozzle, and disposed higher than the two or more lower nozzles to spray water toward a second area on the inner circumferential surface of the drum 40.

If a first area and a second area are defined when viewed from a front side of the drum with reference to a vertical line passing the center of a ring-shaped gasket 60 installed at the entrance of the tub 31, there may be provided: a first middle nozzle disposed higher than the center of the gasket 60 in the first area to spray water downward toward the second area; a first lower nozzle disposed lower than the center of the gasket 60 in the first area to spray water upward toward the second area; a second middle nozzle disposed higher than the center of the gasket 60 in the second area to spray water downward toward the first area; and a second lower nozzle disposed lower than the center of the gasket 60 in the second area to spray water upward toward the first area. In this case, water pumped by the circulation pump 36 may be guided to the first lower nozzle, the first middle nozzle, the second lower nozzle, and the second middle nozzle.

Furthermore, upper nozzles may be provided higher than the first and second middle nozzles. The upper nozzles may be nozzles for spraying circulating water, or direct water nozzles for supplying water, not mixed with detergent, flowing through a water supply valve. Alternatively, the upper nozzles may be nozzles for supplying water which is mixed with textile softener after passing through a detergent box with the textile softener filled therein.

The first and second lower nozzles and the first and second middle nozzles may be supplied with circulating water through a circulating water guide flow path. For example, the guide flow path may include an inlet port connected to the circulating water guide pipe 18, and a first guide flow path and a second guide flow path, which are branched from the inlet port. The first lower nozzle and the first middle nozzle may be provided in the first guide flow path, and the second lower nozzle and the second medium nozzle may be provided in the second guide flow path.

In the detergent dissolving step, the rotation speed of the circulation pump 36 may be set such that water is sprayed only through the first lower nozzle and the second lower nozzle and not sprayed through the first middle nozzle and the second middle nozzle.

In the detergent dissolving step, the circulation pump 36 acts as a kind of an agitator that stirs wash water so as to dissolve detergent uniformly. In the detergent dissolving step, the circulation pump 36 rotates at a speed so low that water sprayed from the nozzle 83*a* or 83*b* is not allowed to reach laundry in the drum 40, and thus that water with detergent incompletely dissolved therein is prevented from acting on the laundry.

As the above-described detergent dissolving step is performed, detergent may be effectively dissolved in water in the initial washing stage, thereby enhancing washing effect in a washing step.

In addition, even when there is not enough water in the drum in the initial washing stage, the circulation pump motor may rotate, thereby effectively dissolving detergent.

The processor 91 may perform control such that the washing motor is repeatedly accelerated and braked while the circulation pump 36 rotates at the first rotation speed. In this case, laundry in the drum 40 becomes stuck to the inner circumferential surface of the drum 40 in response to the acceleration of the washing motor 93 and falls from the inner circumferential surface in response to the braking of the washing motor 93.

In the detergent dissolving step, the washing motor 91 may be braked when laundry is lifted from a lowest point in the drum 40 to a height corresponding to a set angle which is set less than a rotation angle less than 180 degrees of the drum 40. That is, in the detergent dissolving step, the falling trigger motion by braking may be performed.

Although not illustrated, an additional water supplying step of supplying water into the tub 31 to increase the level of water in the tub 31 from the first water level to a second water level is performed after the detergent dissolving step.

When the level of water in the tub 31 is increased to the second water level by the additional water supplying step, a laundry soaking step of repeating acceleration and deceleration of the washing motor 93 such that the circulation pump 36 is accelerated in response to the acceleration of the washing motor 93 and decelerated in response to the deceleration of the washing motor 93 is performed. In the laundry soaking step, circulating water may be sprayed through the at least one nozzle 83*a* or 83*b* with water pressure higher than in the detergent dissolving step.

According to an embodiment, in the laundry soaking step, circulating water may be sprayed through the first and second lower nozzles and the first and second middle nozzles.

After the laundry soaking step, a washing step (see, the "Washing" step in FIG. 20) may be performed. In the washing step, continuously rotating the washing motor 93 may be performed multiple times. Hereinafter, the course of accelerating the washing motor 93 to a predetermined speed, rotating the washing motor 93 with maintaining the predetermined speed, and braking the washing motor 93 to stop is defined as one rotation cycle. This rotation cycle may correspond to a rolling motion or a tumbling motion.

The rotation cycle may be repeated multiple times. In addition, while the rotation cycle is repeated, operating and stopping of the circulation pump 36 may be repeated. Whenever the rotation cycle starts, the circulation pump 36 may start to operate. While the rotation cycle stops (that is, an interval between rotation cycles), the circulation pump 36 may stop operating (see (a) and (b) of FIG. 20).

In the course of repeatedly operating the circulation pump 36 multiple times, the rotation speed of the circulation pump 36 may increase. Specifically, multiple-times operation of the circulation pump 36 may include: a first operation in which the circulation pump 36 rotates at a first rotation speed; and a second operation the circulation pump 36 rotates at a second rotation speed higher than the first rotation speed after the first operation. Here, the second operation indicates the case where the circulation pump 36 rotates at a speed increased than before, and the first operation is an operation performed right before the second operation, in which the circulation pump 36 rotates at a speed which has yet to be accelerated.

Meanwhile, a step of additionally supplying water into the tub 32 during the washing step may be further implemented. "Additional Water Supply" in (a) of FIG. 20 indicates a time when water is additionally supplied into the tub 31.

When the circulation pump 36 operates after water is additionally supplied into the tub 31, the rotation speed of the circulation pump 36 may be set to be higher than in a previous operation. Since an amount of water contained in the tub 31 is increased due to the additional supply of water, the circulation pump 36 is controlled to rotate at a higher speed, increasing pressure and a flow rate of water sprayed through the at least one nozzle 83*a* or 83*b* and a flow rate.

According to an embodiment, in the washing step, water may be sprayed through both the one pair of lower nozzles and the one pair of middle nozzles by the rotation of the circulation pump 36.

Meanwhile, in the washing step, the washing pump 36 may be controlled such that water pumped by the circulation pump 36 is sprayed through the pair of lower nozzles but now allowed to reach the pair of middle nozzles.

In addition, in the washing step, while water is sprayed through the one pair of middle nozzles and the one pair of lower nozzles, the water may be sprayed through a direct water nozzle 57.

After the washing step, a rinsing step ("Rinsing" in FIG. 20) may be performed. That is, a step of accelerating the washing motor 93 to a preset contact maintaining speed such that laundry in the drum 40 rotates while stuck to the inner circumferential surface of the drum 40, and controlling the washing motor 93 to rotate with maintaining the contact maintaining speed may be performed. A driving motion of the drum 40 in this step may correspond to the above-described filtration motion.

In order to spray water through at least one nozzle during the filtration motion, a step of accelerating the circulation pump 36 in response to the acceleration of the washing motor 93 may be performed.

By employing the method for controlling a washing machine according to this embodiment, the intensity of water sprayed through the nozzle 83*a* or 83*b* may be adjusted in response to a change in the water level of the drum 40, thereby enhancing washing performance.

In addition, washing may be performed with highly detergent concentrated wash water at a low maintained water level of the drum 40 and then washing is performed at an increased water level, thereby enhancing washing performance.

If the rotation speed of the circulation pump motor 92 is maintained to be a high speed, the level of water in the drum 40 decreases and additional supply of water is needed. In this case, more water may be used to wash laundry or it may be difficult to wash laundry with highly detergent concentrated wash water. According to this embodiment, as the rotation speed of the circulation pump motor 92 changes according to the level of water in the drum 40, a less amount of water may be used in washing laundry and a highly concentrated washing operation may be performed.

In addition, if the level of water in the drum 40 rises by the additional water supply, pressure of water to be sprayed through a nozzle is increased, thereby improving washing performance with a physical impact by water pressure.

In addition, an amount of additional supply water, a rotation speed of the circulation pump motor, and an interval between water supplies change according to a water level of wash water, thereby enabling efficient washing and reducing the entire washing cycle.

Figure 21:
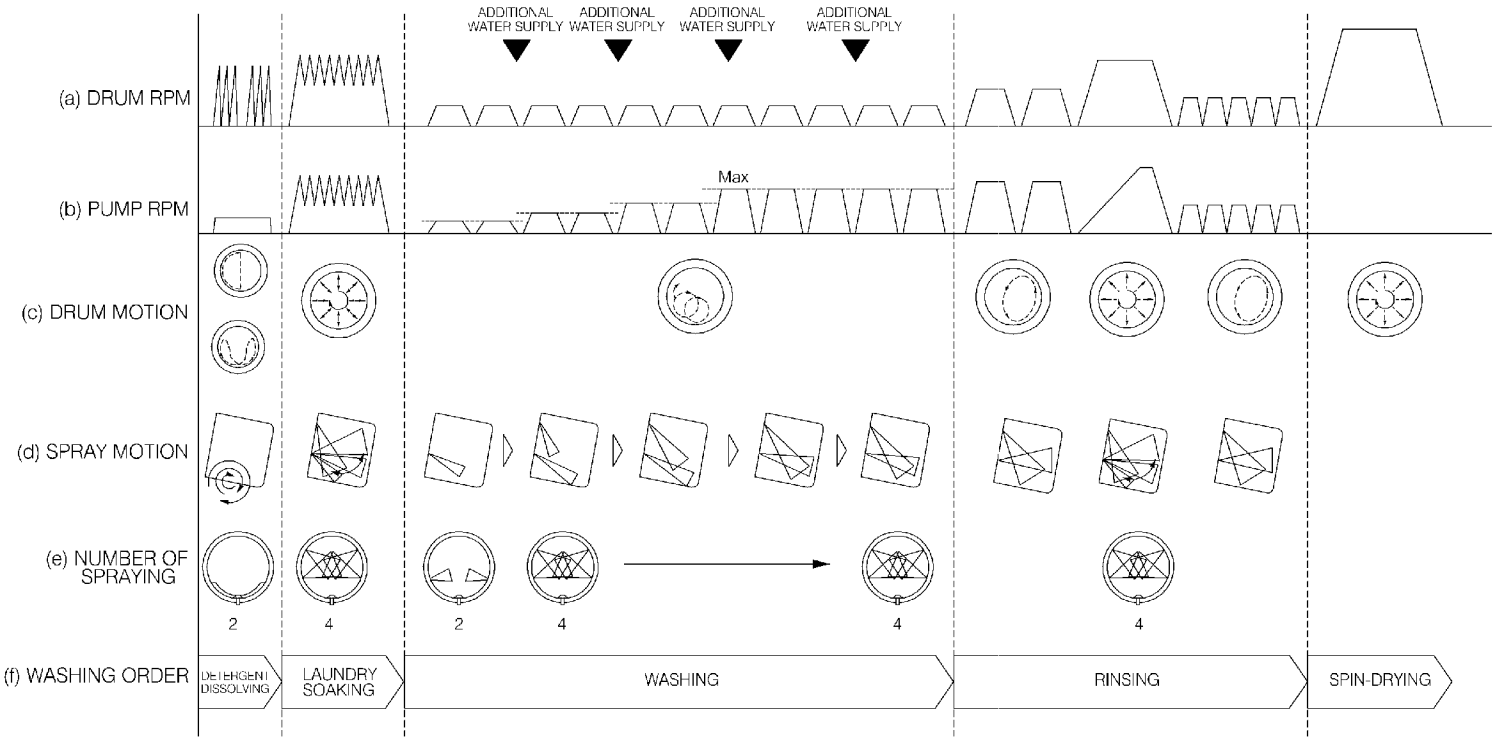
FIG. 21 is a diagram for explanation of a method for controlling a washing machine according to another embodiment of the present invention.

FIG. 21 is a diagram for explanation of a method for controlling a washing machine according to another embodiment of the present invention. The embodiment described with reference to FIG. 21 may be another embodiment of the above-described washing step.

A step of repeating acceleration and deceleration of the circulation pump 36 while the washing motor continuously rotates in one direction one or more ties may be performed. While the washing motor 93 continuously rotates in one direction, laundry in the drum 32 may be lifted to a predetermined height and falls therefrom, repeatedly. In this case, the circulation pump 36 may run one cycle while the washing motor 93 runs two or more cycles. In an embodiment, it is illustrated that the circulation pump 36 runs one cycle while the washing motor 93 runs three cycles, but this is merely an example.

Water supply to the tub 31 may be performed in phases. The processor 91 may control the water supply valve 94 such that the level of water in the tub 31 rises to a first water level H1 (the first water supply). A first cycle in which the circulation pump 36 rotates at a first speed Pr(R, H1) may be performed when the level of water in the tub 31 reaches the first water level H1. The rotation speed Pr(R, H1) may be 1800 to 2200 rpm (preferably 2000 rpm).

In a structure where one pair of the lower nozzles and one pair of the middle nozzles are provided, if the rotation pump motor 92 rotates at the rotation speed Pr(R, H1), water may be sprayed only through the one pair of the lower nozzles but not through the one pair of the middle nozzles. That is, if the circulation pump motor 92 rotates at the rotation speed Pr(R, H1), discharge pressure of the circulation pump 36 is not sufficient to increase water so as to reach the one pair of the middle nozzles and be sprayed therefrom. However, even in this case, water may be sprayed through the one pair of the lower nozzles, and thus, the circulation pump motor 92 does not run idle.

After the first cycle of the circulation pump 36, the processor 91 may control the water supply valve 94 such that the level of water in the tub 31 rises to a second water level H2 (the second water supply). A second cycle in which the circulation pump 36 rotates at a second speed PR(R, H2) may be performed when the level of water in the tub 31 reaches the second water level H2. The rotation speed Pr(R, H2) may be 2250 to 2750 rpm (preferably, 2500 rpm).

After the second cycle of the circulation pump 36, the processor 91 may control the water supply valve 94 such that the level of water in the tub 31 reaches a third water level H3 (the third water supply). A third cycle in which the circulation pump 36 rotates at a third rotation speed Pr(R, H3) may be performed when the level of water in the tub 31 reaches the third water level H3.

After the third cycle of the circulation pump 36, the processor 91 may control the water supply valve 94 such that the level of water in the tub 31 reaches to a fourth water level H4 (the fourth water supply). A fourth cycle of the circulation pump 36 may be performed when the fourth water supply is already provided, and, in this case, the circulation pump 36 may rotate at the third speed PR(R, H3), as the same as in the third cycle. The rotation speed Pr(R, H3) may be 2520 to 3080 rpm (preferably 2800 rpm).

Meanwhile, the processor 91 may control the water supply valve 94 such that water is sprayed through the direct water nozzle 57 upon the last water supply in the washing step (the fourth water supply in this embodiment). In this case, water may be supplied to a softener accommodator of the dispenser 35 in which textile softener is contained, and accordingly, the water may be supplied with the textile softener to the water injection nozzle 57.

Water introduced through the water supply valve 94 may pass through the softener accommodator along a predetermined flow path and be then supplied to the direct water nozzle 57 together with textile softener.

However, aspects of the present invention are not limited thereto, and raw water (water supplied from an external water source) may be sprayed through the direct water nozzle 58, and, during this jetting operation, water having passed through the softener accommodator of the dispenser 35 may be supplied directly to the tub 31.

Meanwhile, the direct water nozzle 57 may be disposed higher than the one pair of the middle nozzles. Preferably, the middle nozzles are respectively provided on the left side and the right side of the gasket 60 and the direct water nozzle 57 may be interposed between the middle nozzles.

In addition, the one pair of the lower nozzles may be respectively disposed on the left side and the right side of the gasket 60. In this case, when water is simultaneously sprayed from the direct water nozzle 57, the one pair of the middle nozzles, and the one pair of the lower nozzles, water streams may form a star shape, when viewed from front.

Meanwhile, referring to FIG. 21, the processor 91 may control additional water supply on a time basis. That is, the processor 91 may start the first water supply at a time t=t(w1), the second water supply at a time t=t(w2), the third water supply at a time t=t(w3), and the fourth water supply at a time t=t(w4).

In this case, a time interval t(w2)-t(w1) between the first water supply and the second water supply, a time interval t(w3)-t(w2) between the second water supply and the third water supply, and a time interval t(w4)-t(w3) between the third water supply and the fourth water supply may be preset values.

The processor 91 may set the time interval t(w3)-t(w2) between the second water supply and the third water supply to be greater than the time interval t(w2)-t(w1) between the first water supply and the second water supply. It is because, if the water level of wash water in the drum 40 rises, a longer washing time may be required.

Likewise, the processor 91 may set the time interval t(w4)-t(w3) between the third water supply and the fourth water supply to be different from the time interval t(w2)-t(w1) between the first water supply and the second water supply or the time interval t(w3)-t(w2) between the second water supply and the third water supply.

The processor 91 may set an amount of increase in the rotation speed of the circulation pump motor 92 based on an amount of water supplied in each of the first water supply to the third water supply. According to the amount of increase in the rotation speed of the circulation pump motor 92, the processor 91 may accelerate the circulation pump motor 92 at a time when each of the first water supply to the third water supply is performed.

However, the rotation speed of the circulation pump motor 92 may be set not to exceed the highest rotation speed that is set according to a sensed laundry load. The processor 91 may set the highest rotation speed of the circulation pump motor 92 according to a laundry load sensed in the laundry load sensing step.

The processor 91 may accelerate the circulation pump motor 92 in phases until reaching the set highest rotation speed. After the rotation pump motor 92 reaches the highest rotation speed, the processor 91 may control the circulation pump motor 92 to maintain the highest rotation speed despite a change in the level of water in the drum 40.

Even when the level of water in the drum 40 rises in phases by additional water supply, the processor 91 may maintain the highest rotation speed of the circulation pump motor 92 without accelerating the circulation pump motor 92 beyond the highest rotation speed. According to an embodiment, upon the last water supply in the washing step (the fourth water supply in this embodiment, detergent-dissolved water may be supplied to the tub 31. The dispenser 35 may further include a detergent accommodator in which detergent is contained. Water introduced through the water supply valve 94 may pass through the detergent accommodator along a predetermined flow path and be then supplied to the tub 31 together with detergent.

The present invention as described above may be implemented as code that can be written on a computer-readable medium in which a program is recorded and thus read by a computer. The computer-readable medium includes all kinds of recording devices in which data is stored in a computer-readable manner. Examples of the computer-readable recording medium may include a hard disk drive (HDD), a solid state disk (SSD), a silicon disk drive (SDD), a read only memory (ROM), a random access memory (RAM), a compact disk read only memory (CD-ROM), a magnetic tape, a floppy disc, and an optical data storage device. In addition, the computer-readable medium may be implemented as a carrier wave (e.g., data transmission over the Internet). In addition, the computer may include a processor or a controller.

What is claimed is:

1. A washing machine comprising:

a casing having a front surface that defines a case opening;

a tub disposed in the casing and configured to receive water, the tub having a tub opening that is accessible through the case opening;

a drum that is rotatably disposed in the tub and configured to receive laundry through the case opening and the tub opening;

at least one nozzle configured to spray water into the drum;

a washing motor configured to rotate the drum;

a circulation pump configured to circulate water within the washing machine, the circulation pump comprising a circulation pump motor;

at least one processor; and at least one computer memory that is operably connectable to the at least one processor and that has stored thereon instructions which, when executed, cause the at least one processor to perform operations comprising:

supplying water into the tub to a first water level of the tub;

operating the circulation pump at a first speed;

in a state in which the circulation pump is operated at the first speed, controlling a rotation of the drum by operating the washing motor to repeatedly alternate between an acceleration and a deceleration of a rotation speed of the drum so that laundry in the drum alternates between maintaining contact with an inner circumferential surface of the drum and separating from the inner circumferential surface of the drum;

further supplying water to the tub to raise a level of water in the tub from the first water level to a second water level; and repeatedly alternating between (i) an acceleration of a pump speed of the circulation pump based on the acceleration of the rotation speed of the drum and (ii) a deceleration of the pump speed of the circulation pump based on the deceleration of the rotation speed of the drum, wherein operating the circulation pump at the first speed comprises setting the first speed to limit a discharge range of water from the circulation pump within at least one of a first range in which water discharged from the circulation pump does not reach the at least one nozzle or a second range in which water sprayed from the at least one nozzle reaches an area of the drum between a front surface of the drum and a rear surface of the drum, wherein the at least one nozzle comprises:

two or more lower nozzles configured to spray water toward a first area of the inner circumferential surface of the drum, and two or more middle nozzles that are configured to receive water from a flow path shared with the two or more lower nozzles, that are disposed vertically higher than the two or more lower nozzles, and that are configured to spray water toward a second area of the inner circumferential surface of the drum, and wherein the first speed of the circulation pump is set to supply water only to the two or more lower nozzles such that water is not sprayed into the drum through the two or more middle nozzles while the two or more lower nozzles spray water into the drum.

2. The washing machine of claim 1, wherein the operations further comprise:

after repeatedly alternating between the acceleration of the pump speed of the circulation pump and the deceleration of the pump speed of the circulation pump, repeatedly alternating between an operation of the circulation pump and a stoppage of the circulation pump multiple times in a state in which the washing motor is rotated in one direction.

3. The washing machine of claim 2, wherein repeatedly alternating between the operation and the stoppage of the circulation pump is performed while operating the washing motor in the one direction to cause laundry in the drum to be raised to a predetermined height in the drum and to fall from the predetermined height into the drum.

4. The washing machine of claim 2, wherein controlling the rotation of the drum comprises:

decelerating the washing motor based on the drum being rotated by a rotation angle that is greater than or equal to 360 degrees with respect to a reference position, and wherein repeatedly alternating between the operation and the stoppage of the circulation pump comprises repeatedly alternating between the operation and the stoppage of the circulation pump in a state in which the washing motor is decelerated.

5. The washing machine of claim 2, wherein repeatedly alternating between the operation and the stoppage of the circulation pump comprises performing the operation of the circulation pump a plurality of times based on a continuous rotation of the washing motor in one direction, and wherein performing the operation of the circulation pump the plurality of times comprises:

rotating the circulation pump at a first pump speed; and after rotating the circulation pump at the first pump speed, rotating the circulation pump at a second pump speed that is greater than the first pump speed.

6. The washing machine of claim 2, wherein the operations further comprise:

additionally supplying water into the tub while the circulation pump is repeatedly operated and stopped, wherein repeatedly alternating between the operation and the stoppage of the circulation pump multiple times comprises:

setting a pump rotation speed of the circulation pump in a subsequent operation of the circulation pump to be higher than a pump rotation speed of the circulation pump in a prior operation of the circulation pump; and operating the circulation pump after additionally supplying water into the tub.

7. The washing machine of claim 2, wherein repeatedly alternating between the operation and the stoppage of the circulation pump comprises controlling a rotation of the circulation pump to spray water through both (i) the two or more lower nozzles and (ii) the two or more middle nozzles.

8. The washing machine of claim 1, wherein the first speed of the circulation pump is less than or equal to 1500 revolutions per minute (rpm).

9. The washing machine of claim 1, wherein, based on the circulation pump operating at the first speed, water sprayed from the at least one nozzle does not reach the front surface of the drum.

10. The washing machine of claim 1, wherein controlling the rotation of the drum further comprises:

while maintaining the circulation pump at the first speed, repeating a braking operation and the acceleration of the rotation speed of the drum to a first drum speed.

11. The washing machine of claim 10, wherein the rotation speed of the drum decreases by each braking operation from the first drum speed to zero revolutions per minute (rpm).

12. The washing machine of claim 1, wherein controlling the rotation of the drum comprises:

while operating the circulation pump at the first speed, applying a braking operation to the washing motor to decelerate the rotation speed of the drum based on laundry in the drum being raised to a height in the drum corresponding to a set angle that is less than 180 degrees from a reference point of the drum.

* * * * *